US009512652B2

(12) United States Patent
Ono et al.

(10) Patent No.: US 9,512,652 B2
(45) Date of Patent: Dec. 6, 2016

(54) OPENING/CLOSING OPERATION DEVICE FOR VEHICLE OPEN/CLOSE DOOR

(75) Inventors: Tatsuro Ono, Miyazaki (JP); Hiroto Fujiwara, Miyazaki (JP); Yuichi Nakamura, Miyazaki (JP); Yuichiro Yamaoka, Saitama (JP); Masatoshi Adachi, Saitama (JP)

(73) Assignees: Kabushiki Kaisha Honda Lock, Miyazaki (JP); Honda Motor Co., Ltd., Tokyo (JP)

( * ) Notice: Subject to any disclaimer, the term of this patent is extended or adjusted under 35 U.S.C. 154(b) by 469 days.

(21) Appl. No.: 13/988,811

(22) PCT Filed: Jul. 27, 2011

(86) PCT No.: PCT/JP2011/067074

§ 371 (c)(1),
(2), (4) Date: May 22, 2013

(87) PCT Pub. No.: WO2012/070280

PCT Pub. Date: May 31, 2012

(65) Prior Publication Data

US 2013/0233034 A1 Sep. 12, 2013

(30) Foreign Application Priority Data

Nov. 26, 2010 (JP) ..... 2010-263671
Nov. 26, 2010 (JP) ..... 2010-263672
Nov. 26, 2010 (JP) ..... 2010-263673

(51) Int. Cl.
*E05B 85/10* (2014.01)
*E05B 79/06* (2014.01)
(Continued)

(52) U.S. Cl.
CPC ..... *E05B 85/10* (2013.01); *E05B 79/06* (2013.01); *E05B 85/06* (2013.01); *E05B 85/16* (2013.01); *Y10T 70/5199* (2015.04); *Y10T 292/57* (2015.04)

(58) Field of Classification Search
CPC ..... Y10T 70/5199; E05B 79/06; E05B 85/06; E05B 85/10; E05B 85/16
(Continued)

(56) References Cited

U.S. PATENT DOCUMENTS 7,437,803 B2 * 10/2008 Watanabe et al. ..... 16/412
7,597,364 B2 10/2009 Muneta
8,424,936 B2 * 4/2013 Muller et al. ..... 292/336.3

FOREIGN PATENT DOCUMENTS

CN 1924261 A 3/2007
DE 196 42 698 A1 4/1998
(Continued)

OTHER PUBLICATIONS

Supplementary European Search Report dated Jul. 24, 2014 issued in the corresponding EP patent application 11 84 3417.
(Continued)

*Primary Examiner* — Kristina Fulton
*Assistant Examiner* — Thomas Neubauer
(74) *Attorney, Agent, or Firm* — Carrier Blackman & Associates, P.C.; Joseph P. Carrier; Jeffrey T. Gedeon

(57) ABSTRACT

In an opening/closing operation device for a vehicle open/close door, a handle and a lever for transmitting an unlock operation force to a latch mechanism are turnably supported by an open/close door, and one end portion of the lever is brought into contact with a contact surface formed in the handle. In the contact surface, at least a portion to be in contact with the one end portion of the lever at an initial stage of the manipulation of the handle is formed in an inclined manner or curvedly: in a way that makes the portion situated more forward in a movement direction, in which the contact surface moves in response to the turn of the handle, as the portion comes closer to a rotary fulcrum of the lever in a direction along a plane orthogonal to the movement direction such that the portion intersects the plane.

11 Claims, 17 Drawing Sheets

(51) Int. Cl.
*E05B 85/16* (2014.01)
*E05B 85/06* (2014.01)

(58) Field of Classification Search
USPC ..... 292/336.3
See application file for complete search history.

(56) References Cited

FOREIGN PATENT DOCUMENTS

| | | | |
|---|---|---|---|
| FR | 2 802 563 | A1 | 6/2001 |
| JP | 62-12757 | Y2 | 4/1987 |
| JP | H10-266642 | A | 10/1998 |
| JP | 2001-323689 | A | 11/2001 |
| JP | 2003-027773 | A | 1/2003 |
| JP | 3486070 | B2 | 1/2004 |
| JP | 2005-002567 | A | 1/2005 |
| JP | 2008-156935 | A | 7/2008 |
| JP | 2008-248496 | A | 10/2008 |
| JP | 2009-243148 | A | 10/2009 |
| WO | 2010/067870 | A1 | 6/2010 |

OTHER PUBLICATIONS

Chinese Official Action dated Oct. 8, 2014 issued in the corresponding CN Patent Application No. 201180056587.2.

* cited by examiner

OPENING/CLOSING OPERATION DEVICE FOR VEHICLE OPEN/CLOSE DOOR

TECHNICAL FIELD

The present invention relates to an opening/closing operation device for a vehicle open/close door in which: a handle for opening and closing an open/close door by turning manipulation and a lever for transmitting an unlock operation force to a latch mechanism are turnably supported by the open/close door, the latch mechanism provided in the open/close door in a way that makes the latch mechanism capable of maintaining a close lock state of the open/close door; and one end portion of the lever is brought into contact with a contact surface formed in the handle at a position offset from a rotary fulcrum of the handle in a way that makes the lever performs turning operation in response to a turning manipulation of the handle.

BACKGROUND ART

Patent Document 1 and the like have already made known a handle device of a vehicle in which: a handle, whose one end portion is turnably supported by an ingress/egress door of a vehicle, integrally has a guide arm portion in the other end portion of the handle; one end portion of a lever, which is turnably supported by the ingress/egress door in a way that makes the lever capable of transmitting an unlock operation force to a latch mechanism, is brought into contact with a contact surface formed in the guide arm portion; and the lever is driven to turn by being pushed by the contact surface, in response to manipulation of the handle in a direction in which the ingress/egress door is opened.

PRIOR ART DOCUMENT

Patent Document

Patent Document 1: Japanese Patent No. 3486070

SUMMARY OF THE INVENTION

Problems to be Solved by the Invention

Meanwhile, in the handle device disclosed in Patent Document 1 above, however, the contact surface of the guide arm portion is shaped like a flat surface orthogonal to a direction in which the contact surface moves in response to the manipulation of the handle. Hence, although a torque required in an initial stage of an action is relatively large, a rotary component force which acts on the lever from the contact surface of the guide arm portion in response to the manipulation of the handle is not large. Furthermore, when the rotary fulcrum of the lever is set at a position close to the guide arm portion to increase a turning range of the lever, a lever ratio becomes smaller. Hence, a user sometimes feels that the load is heavy in the initial stage of the manipulation of the handle in a direction in which the open/close door is opened.

The present invention is made in view of the circumstances described above, and an object thereof is to provide an opening/closing operation device of a vehicle open/close door which is designed to be capable of applying large rotational torque to a lever with a small operational force at least at an initial stage of manipulation of a handle.

Means for Solving the Problems

In order to attain the above object, according to a first aspect of the present invention, there is provided an opening/closing operation device for a vehicle open/close door in which: a handle for opening and closing an open/close door by turning manipulation and a lever for transmitting an unlock operation force to a latch mechanism are turnably supported by the open/close door, the latch mechanism provided in the open/close door in a way that makes the latch mechanism capable of maintaining a close lock state of the open/close door; and one end portion of the lever is brought into contact with a contact surface formed in the handle at a position offset from a rotary fulcrum of the handle in a way that makes the lever performs turning operation in response to a turning manipulation of the handle, characterized in that in the contact surface, at least a portion to be in contact with the one end portion of the lever at an initial stage of the manipulation of the handle toward an opening side of the open/close door is formed in an inclined manner or curvedly: in a way that makes the portion situated more forward in a movement direction, in which the contact surface moves in response to the turn of the handle, as the portion comes closer to a rotary fulcrum of the lever in a direction along a plane orthogonal to the movement direction; and in a way that makes the portion intersect the plane.

Furthermore, according to a second aspect of the present invention, in addition to the configuration of the first aspect, the contact surface includes: an initial-stage contact portion which is formed in an inclined manner or curvedly in a way that makes the initial-stage contact portion situated more forward in the movement direction of the contact surface as the initial-stage contact portion comes closer to the rotary fulcrum of the lever in the direction along the plane orthogonal to the movement direction, and in a way that makes the initial-stage contact portion intersect the plane, and the initial-stage contact portion being configured to come into contact with the one end portion of the lever at the initial stage of the manipulation of the handle; and a latter-stage contact portion which is formed so as to be along the plane, and which is continuous with the initial-stage contact portion in a way that makes the latter-stage contact portion come into contact with the one end portion of the lever at a latter stage of the manipulation of the handle.

According to a third aspect of the present invention, in addition to the configuration of the first aspect, the handle integrally has: a grip portion disposed on an outer side of a panel included in the open/close door; and a guide arm portion whose base end portion is provided continuously with the grip portion, the guide arm portion being inserted into the open/close door, the contact surface being formed on a tip end side of the guide arm portion, the contact surface facing the grip portion, a base member is attached to the panel, the base member having: an insertion hole in which the guide arm portion is moveably inserted; and a lever supporting portion which turnably supports the lever via a pivot, the lever supporting portion is formed of a pair of side walls which are disposed respectively on opposite sides of the lever and which respectively have coaxial supporting holes for inserting and supporting opposite end portions of the pivot penetrating a pivot hole provided in the lever, an assembly guide portion and a stopper are disposed between both of the side walls and are provided in the base member, the assembly guide portion guiding a manner in which the lever, to which a return spring is assembled with one end portion of the return spring engaging with the lever, is pushed into a space between both of the side walls in a way that makes another end portion of the return spring engage with one of the side walls with the one end portion of the lever coming in contact with the contact surface, the return spring provided between the lever supporting portion and the lever in a way that turns and biases the lever in a direction in which the one end portion of the lever is brought into contact with the contact surface, and the stopper restricting the lever, which is pushed into the space between both of the side walls, at a position that makes the pivot hole correspond to the supporting holes of the side walls, and a turning position of the lever, which is pushed into the space between both of the side walls until being restricted by the stopper and which is turned and biased by a spring force exerted by the return spring, is restricted by the contact of the lever with the contact surface and the base member.

According to a fourth aspect of the present invention, in addition to the configuration of the third aspect, a protrusion and a spring supporting portion are provided in a side wall of the pair of side walls with which the other end portion of the return spring engages, the protrusion hooking the other end portion of the return spring when the lever, to which the return spring is assembled, is pushed into the space between both of the side walls while being guided by the assembly guide portion, the spring supporting portion causing the other end portion of the return spring to be unhooked from the protrusion and to slide while maintaining an engaged state as the lever is pushed into the space between both of the side walls while being guided by the assembly guide portion.

According to a fifth aspect of the present invention, in addition to the configuration of the third or fourth aspect, the assembly guide portion is provided in the base member in a way that makes the assembly guide portion cover, from above, at least a portion of the spring on the panel side, with the base member attached to the open/close door.

According to a sixth aspect of the present invention, in addition to the configuration of the first aspect, one end portion of the handle having a grip portion is turnably supported by a panel, the grip portion disposed on an outer side of the panel forming at least part of the open/close door, a fitting groove, to which an edge portion of a through-hole is fitted, is provided in one of an upper portion and a lower portion of a base member being attached to the panel and integrally having: a base member main portion having an insertion hole in which a guide arm portion is inserted; and a guide portion provided continuously with the base member main portion so as to guide the guide arm portion inserted in the insertion hole, the through-hole provided in the panel with at least the guide portion inserted therein, the guide arm portion included in another end portion of the handle, and the contact portion formed in a tip end side of the guide arm portion, an engagement groove opened in a direction opposite to an opening direction of the fitting groove is provided in the other one of the upper portion and the lower portion of the base member, and an attachment member able to be fastened to the base member with at least the panel interposed between the attachment member and the base member main portion is engaged with the engagement groove with the position thereof relative to the base member in an up-down direction being restricted by the slide of the attachment member on a back surface of the panel while in slide contact with the back surface of the panel.

According to a seventh aspect of the present invention, in addition to the configuration of the sixth aspect, a position restriction recess portion opened in one horizontal direction is provided in one of the base member and the attachment member, and a position restriction protruding portion is provided in the other one of the base member and the attachment member, the position restriction protruding portion engaging with the position restriction recess portion when the attachment member engages with the engagement groove and thereby restricting the position of the attachment member relative to the base member in the up-down direction.

According to an eighth aspect of the present invention, in addition to the configuration of the sixth aspect, the attachment member is formed extending between opposite end portions of the handle in a longitudinal direction, and an engagement arm portion is provided in the attachment member, the engagement arm portion being engageable from above with the handle supporting portion which protrudes to an inner side of the panel in a way that makes the handle supporting portion turnably supports the one end portion of the handle.

According to a ninth aspect of the present invention, in addition to the configuration of the sixth aspect, an engagement protruding portion engaging with the engagement groove is provided integrally to the attachment member, and a restriction protruding portion is projectingly provided to a back surface of a sealing member interposed between at least a peripheral edge portion of the base member main portion and an outer surface of the panel, the restriction protruding portion engaging with the attachment member so as to restrict the movement of the attachment member in a sliding direction in which the attachment member engages with engagement groove while in slide contact with the back surface of the panel.

Further, according to a tenth aspect of the present invention, in addition to the configuration of the sixth aspect, a cylinder lock attachment portion protectingly surrounding a cylinder lock is provided integrally to the attachment member with the cylinder lock attached thereto.

Here, an ingress/egress door 21 of embodiments corresponds to an open/close door of the present invention; an outer panel 22 of the embodiments corresponds to the panel of the present invention; a second base member 25A, 25B of the embodiments corresponds to the base member of the present invention; a second sealing member 34 of the embodiments corresponds to the sealing member of the present invention; and a second through-hole 42 of the embodiments corresponds to the through-hole of the present invention.

Effects of the Invention

According to the first aspect of the present invention, at least at the initial stage of the manipulation of the handle toward the opening side of the open/close door, the one end portion of the lever is in contact with the portion which is inclined or curved in a way that makes the portion situated more forward in the movement direction of the contact surface as the portion comes closer to the rotary fulcrum of the lever in the direction along the plane orthogonal to the movement direction. Accordingly, the rotary component force which acts on the lever from the contact surface can be made larger than if the one end portion of the lever would come into contact with a flat-shaped contact surface orthogonal to the movement direction of the contact surface. In addition, the friction resistance force occurring between the lever and the contact surface is made relatively small. Hence, large rotating torque can be applied to the lever with a small operation force. Reducing the manipulation load of the handle at the initial stage of an action thereby makes it possible to eliminate unsmoothness in the manipulation of the handle, and to improve the manipulation feeling of the handle.

According to the second aspect of the present invention, after the initial state of the manipulation of the handle, a lever ratio becomes larger due to the displacement of the portion of the contact of the lever with the contact surface, and rotating torque larger than that in the initial-stage of the manipulation can be applied to the lever. Bringing the one end portion of the lever in contact with the latter-stage contact portion in the contact surface which extends along the plane being orthogonal to the movement direction of the contact surface makes it possible to reduce the change in a manipulation force of the handle, and to obtain smooth action feeling.

According to the third aspect of the present invention, when the lever, to which the return spring is assembled with the one end portion thereof engaging with the lever, is installed in the lever supporting portion formed of the pair of side walls disposed respectively on opposite sides of the lever, the lever can be pushed into the space between both side walls in a way that makes the other end portion of the return spring engage with one of the side walls with the one end portion of the lever coming into contact with the contact surface of the guide arm portion of the handle, by guiding the lever with the assembly guide portion which are provided between the side walls. When the lever pushed into the space is restricted by the stopper, the pivot hole of the lever is at the position corresponding to the supporting holes of both side walls, and further the turning position of the lever pushed into the space between both side walls until being restricted by the stopper is restricted by the contact of the lever with the contact surface and the base member. Hence, the pivot can be inserted into the pivot hole of the lever and the supporting holes of both side walls with a hand removed from the lever. Thus, the work of assembling the lever to the lever supporting portion of the base member is easy, and the assemblability can be thereby improved.

According to the fourth aspect of the present invention, the protrusion for hooking the other end portion of the return spring and the spring supporting portion for sliding the other end portion of the return spring, which is unhooked from the protrusion, while maintaining the engaged state are provided in the side wall with which the other end portion of the return spring is engaged. Hence, the position of the engagement of the other end portion of the return spring with the side wall can be shifted with the state of the engagement between the return spring and the side wall maintained, when the lever, to which the return spring is assembled, is installed in the lever supporting portion. Thus, the work of assembling the lever to the lever supporting portion is made easier, and the assemblability can be thereby improved.

According to the fifth aspect of the present invention, while in the state where the base member is attached to the open/close door, at least the portion of the return spring on the panel side is covered from above with the assembly guide portion. Hence, although the panel of the open/close door is one which faces the outside of the vehicle, the assembly guide portion can prevent water drops running down the back surface of the panel from falling on the return spring, and exert a waterproof mechanism.

According to the sixth aspect of the present invention, the edge portion of the through-hole provided in the panel is fitted into the fitting groove provided in one of the upper portion and the lower portion of the base member. The attachment member is engaged with the engagement groove by the slide of the attachment member on the back surface of the panel while in contact with the back surface of the panel, with at least the panel interposed between the attachment member and the base member main portion of the base member, the engagement groove provided in the other one of the upper portion and the lower portion of the base member in the way that makes the engagement groove open in the direction opposite to the opening direction of the fitting groove. The position of the attachment member relative to the base member in the up-down direction is thereby restricted. Accordingly, the base member and the attachment member can be temporarily assembled to the panel of the open/close door. Hence, a worker is no longer required to perform work while holding the base member and the attachment member, and the base member can be attached to the panel by fastening the attachment member to the base member.

According to the seventh aspect of the present invention, the position restriction protruding portion provided in the other one of the base member and the attachment member engages with the position restriction recess portion which is opened in the one horizontal direction and which is provided in one of the base member and the attachment member, when the attachment member engages with the engagement groove. Hence, it is possible to restrict the position of the attachment member relative to the base member in the up-down direction, and also to prevent the rotation of the attachment member when fastening the attachment member to the base member. In addition, when the assembly position of the attachment member relative to the base member is out of alignment, the position restriction protruding portion cannot engage with the position restriction recess portion. Hence, misalignment can be easily recognized.

According to the eighth aspect of the present invention, although the attachment member is formed extending between opposite end portions of the handle in the longitudinal direction, the temporarily-assembled state of the attachment member can be surely maintained by causing the engagement arm portion provided in the attachment member to engage from above with the handle supporting portion which protrudes to the inner side of the panel so as to turnably support the one end portion of the handle.

According to the ninth aspect of the present invention, the protruding portion is projectingly provided to the back surface of the sealing member, the protruding portion engaging with the attachment member so as to restrict the movement of the attachment member in the sliding direction in which the engagement protruding portion provided integrally to the attachment member in the way that makes the engagement protruding portion engage with the engagement groove engages with engagement groove. Hence, the positions of the base member and the attachment member relative to each other can be maintained more accurately.

According to the tenth aspect of the present invention, the cylinder lock attachment portion protectingly surrounding the cylinder lock is provided integrally to the attachment member, and the cylinder lock is attached to the cylinder lock attachment portion. Thus, a malicious attack on the cylinder lock on the inner side of the open/close door is made difficult, and the anti-theft quality is thereby improved.

EXPLANATION OF REFERENCE NUMERALS AND SYMBOLS

Figure 1:
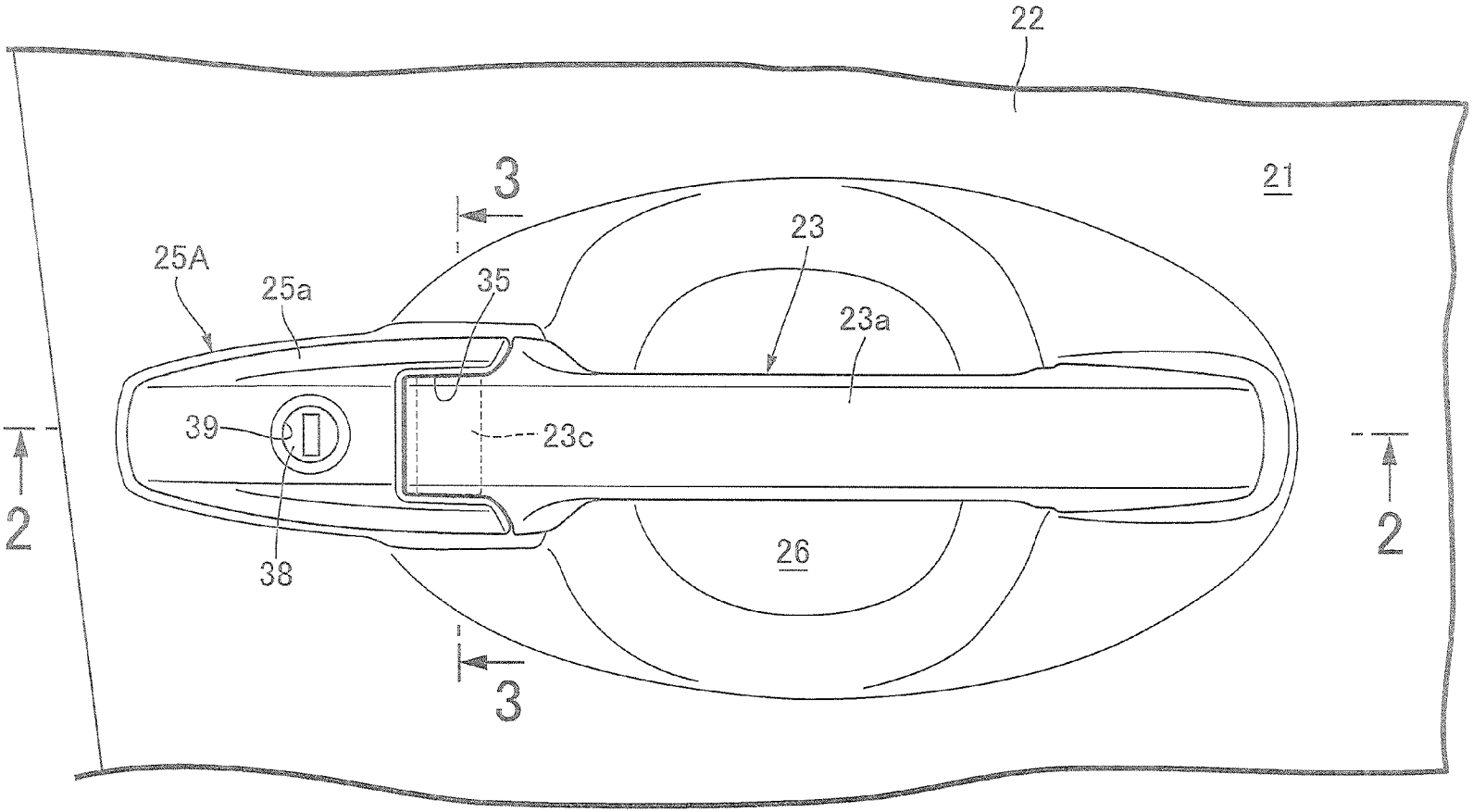
FIG. 1 is a partial side view of an ingress/egress door of a vehicle. (First Embodiment)

21 ingress/egress door being an open/close door
22 outer panel being a panel
23 handle
23*a* grip portion
23*c* guide arm portion
24*a* handle supporting portion
25A, 25B second base member being a base member
25*a* base member main portion
25*b* guide portion
34 second sealing member being a sealing member
36 insertion hole
38 cylinder lock
42 second through-hole being a through-hole
44 lever supporting portion
45 pivot
46 lever
47 contact surface
47*a* initial-stage contact portion
47*b* latter-stage contact portion
50 pivot hole
52 movement direction
53 latch mechanism
54 return spring
54*a* one end portion of return spring
54*b* the other end portion of return spring
55, 56 supporting hole
57, 58 side wall
59 assembly guide portion
61, 62, 63 stopper
64 protrusion
65 spring supporting portion
68, 81 attachment member
68*b* cylinder lock attachment portion
68*e* engagement protruding portion
70 fitting groove
71 engagement groove
74 position restriction recess portion
75 position restriction protruding portion
77 restriction protruding portion
81*d* engagement arm portion
PL plane orthogonal to movement direction of contact surface

MODES FOR CARRYING OUT THE INVENTION

Embodiments of the present invention are described below by referring to the attached drawings.

First Embodiment

A first embodiment of the present invention is described while referring to FIGS. 1 to 12. First, in FIGS. 1 and 2, a handle 23 made of a hard synthetic resin is turnably supported by an outer panel 22 included in an ingress/egress door 21 which is an open/close door included in a passenger vehicle. The handle 23 has a grip portion 23*a*, a supporting arm portion 23*b*, and a guide arm portion 23*c*. The grip portion 23*a* enables a vehicle user to grip the handle 23, and is disposed on an outer side of the outer panel 22 in a way that makes the grip portion 23*a* extend in a front-rear direction of the vehicle (right-left direction in FIG. 1). The supporting arm portion 23*b* is provided continuously and integrally to one end portion (a front end portion in the front-rear direction of the vehicle in the embodiment) of the grip portion 23*a*. The guide arm portion 23*c* is provided continuously and integrally to the other end portion (on a rear end side in the front-rear direction of the vehicle in the embodiment) of the grip portion 23*a*. Moreover, a first base member 24 is attached to the outer panel 22 on the one end side of the handle 23, and a second base member 25A is attached to the outer panel 22 on the other end side of the handle 23.

A curved portion 22*a* for forming a depression 26 is provided in the outer panel 22 in a way that makes the curved portion 22*a* bulge inward, the depression 26 enabling the vehicle user to insert his/her hand between the grip portion 23*a* of the handle 23 and the outer panel 22. First and second attachment seats 27, 28 are provided on an outer face of the outer panel 22, respectively, at positions that make the curved portion 22*a* interposed between both the front and rear sides in the front-rear direction of the vehicle.

A first seat member 29 made of a synthetic resin is interposed between the first base member 24 and the first attachment seat 27. Furthermore, a handle supporting portion 24*a* is provided integrally to a first base member 24. The handle supporting portion 24*a* penetrates the first seat member 29 and the outer panel 22, and is inserted to an inner side of the outer panel 22. Moreover, a metal-made first nut 30 is buried in a face of the first base member 24 which faces the outer panel 22. The first base member 24 is attached to the first attachment seat 27 of the outer panel 22 by screwing and fastening a first bolt 31 to the first nut 30, the first bolt 31 being inserted in the outer panel 22 from the inner side.

The supporting arm portion 23*b* is formed in a way that makes the supporting arm portion 23*b* bent substantially like an L-shape, and is provided continuously and integrally to the one end portion of the grip portion 23*a*. A first through-hole 32 for inserting the supporting arm portion 23*b* to the inner side of the outer panel 22 is provided in the first attachment seat 27 of the outer panel 22 and the first base member 24. The supporting arm portion 23*b* disposed in the handle supporting portion 24*a* is turnably supported by the handle supporting portion 24*a* via a supporting pin 33. In other words, the one end portion of the handle 23 is turnably supported by the outer panel 22 via the first base member 24.

Referring also to FIGS. 3 to 7, the second base member 25A is made of a hard synthetic resin, and integrally has a base member main portion 25*a* and a guide portion 25*b*, as well as is attached to the outer panel 22. The base member main portion 25*a* is disposed on an outer side of the second attachment seat 28 in the outer panel 22. The guide portion 25*b* extends toward the inside of the outer panel 22 from the base member main portion 25*a* so as to guide the guide arm portion 23*c* which is provided continuously to the other end portion of the grip portion 23*a* in the handle 23 at a substantially right angle. A second sealing member 34 made of an elastic material such a rubber or a synthetic resin is interposed between at least a peripheral edge portion of the base member main portion 25*a* and the second attachment seat 28.

A receiving recess portion 35 for receiving the other end portion of the grip portion 23*a* is provided in a portion, on the depression 26 side, of the base member main portion 25*a* of the second base member 25A. The base member main portion 25*a* is formed in a way that makes the base member main portion 25*a* have a shape which enables the grip portion 23*a* and the base member main portion 25*a* appears as if they were unitary when the other end portion of the grip portion 23*a* is received by the receiving recess portion 35. A rectangular insertion hole 36 in which to insert the guide arm portion 23*c* is provided in the receiving recess portion 35 of the base member main portion 25*a*. The guide portion 25*b* is continuous with the insertion hole 36, and is shaped like a rectangular tube.

A base end portion of a nut supporting portion 25*c* protruding into the outer panel 22 is provided continuously and integrally with the base member main portion 25*a* of the second base member 25A on the opposite side of the receiving recess portion 35 from the depression 26. A metal-made second nut 37 is mold-bonded to a tip end portion of the nut supporting portion 25*c*. The metal-made second nut 37 has an axis which is inclined in a way that makes the axis become progressively farther away from the outer panel 22 toward the rear of the vehicle.

A tube portion 25*d* is provided integrally to the second base member 25A, between the guide portion 25*b* and the nut supporting portion 25*c*. The tube portion 25*b* protrudes slightly inward from the base member main portion 25*a* with a cylinder lock 38 continuously connected to the tube portion 25*b*. The cylinder lock 38 is configured to switch between the locking and unlocking of the ingress/egress door 21 by use of a key, which is not illustrated. The base member main portion 25*a* is provided with a key insertion hole 39 for inserting and removing the key to and from the cylinder lock 38 which is continuously connected to the tube portion 25*d*.

A second through-hole 42 for inserting the guide portion 25*b* of the second base member 25A and a third through-hole 43 for inserting the tube portion and the nut supporting portion 25*c* are provided in the second attachment seat 28 of the outer panel 22. The second sealing member 34 is formed in a way that makes the second sealing member 34 surround the second and third through-holes 42, 43 together.

The guide arm portion 23*c* included integrally in the handle 23 is inserted into the guide portion 25*b* from the insertion hole 36 of the second base member 25A in a way that makes the guide arm portion 23*c* moveable in a direction substantially orthogonal to the outer panel 22. Meanwhile, a lever supporting portion 44 is provided integrally to the second base member 25A. A lever 46 is turnably supported by the lever supporting portion 44 by use of a pivot 45 being orthogonal to an axis about which the handle 23 turns and extending in the front-rear direction of the vehicle. The lever 46 is engagedly brought into contact with a contact surface 47 provided in the guide arm portion 23*c*.

The lever 46 is formed so as to integrally includes: a lever main portion 46*a* shaped like a crank; and a supporting tube portion 46*b* provided continuously to one side surface of an intermediate portion of the lever main portion 46*a* at a right angle with the pivot 45 inserted in the supporting tube portion 46*b*. A pivot hole 50, which the pivot 45 penetrates, is provided in the supporting tube portion 46*b* and the lever main portion 46*a*.

Figure 8:
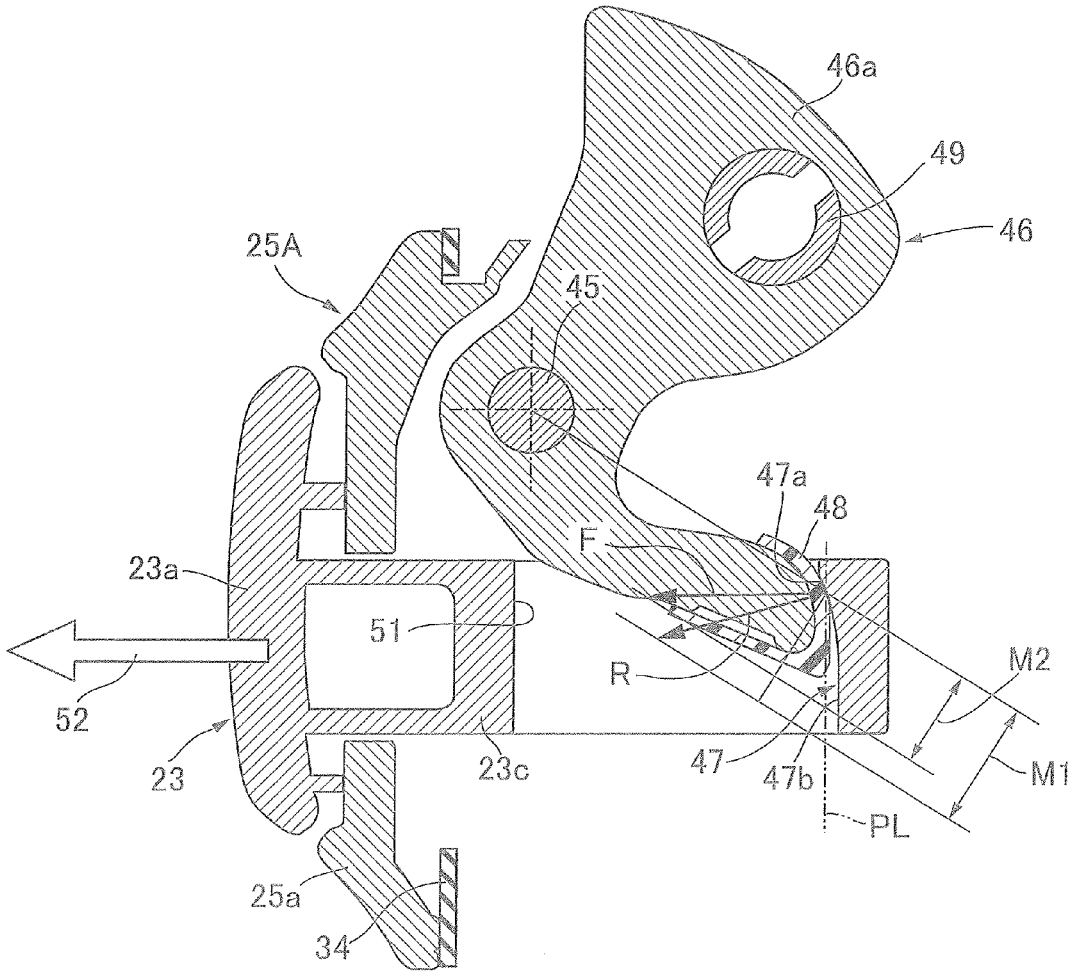
FIG. 8 is a sectional view showing an essential portion of FIG. 3 in an enlarged manner to describe a force which acts on one end portion of a lever from a contact surface. (First Embodiment)

In FIG. 8, one end portion of the lever main portion 46*a* in the lever 46 is inserted into an opening portion 51 which is provided in the guide arm portion 23*c* of the handle 23 and opened on the left and right opposite sides of the guide arm portion 23*c*. Slits 41, 41 disposed respectively on opposite sides of the opening portion 51 are provided in the guide portion 25*b*, shaped like a rectangular tube, in a way that makes the slits 41, 41 extend in an axial direction of the guide portion 25*b*. The one end portion of the lever main portion 46*a* is inserted into the opening portion 51 from one of the slits 41.

The contact surface 47 is formed on one side wall of the opening portion 51 which is on a side of the tip end of the guide arm portion 23*c*, and faces outward. A lever cover 48 made of a resin material with a low coefficient of friction, such as nylon, is attached to the one end portion of the lever main portion 46*a* in a way that makes the lever cover 48 come into contact with the contact surface 47.

Specifically, the contact surface 47 is formed in the handle 23 turnably supported by the ingress/egress door 21, at a position offset from a rotary fulcrum (the supporting pin 33 in the embodiment) of the handle 23. The lever cover 48 in the one end portion of the lever 46 turnably supported by the ingress/egress door 21 via the second base member 25A comes into contact with the contact surface 47 in a way that makes the lever 46 perform turning operation in response to a turning manipulation of the handle 23.

In the contact surface 47, at least a portion, which comes into contact with the lever cover 48 in one end portion of the lever 46 at an initial stage of the manipulation of the handle 23 in a direction toward an opening side of the ingress/egress door 21, is formed in an inclined manner or curvedly: in a way that makes the portion situated more forward in a movement direction 52, in which the contact surface 47 moves in response to the turn of the handle 23, as the portion comes closer to the rotary fulcrum of the lever 46, namely, the pivot 45 in a direction along a plane PL orthogonal to the movement direction 52; and in a way that makes the portion intersect the plane PL.

The contact surface 47 is formed of: an initial-stage contact portion 47*a* coming into contact with the lever cover 48 in the one end portion of the lever 46 at the initial stage of the manipulation of the handle 23; and a latter-stage contact portion 47*b* being continuous with the initial-stage contact portion 47*a* in a way that makes the latter-stage contact portion 47 come into contact with the lever cover 48 in the one end portion of the lever 46 at a latter stage of the manipulation of the handle 23. The initial-stage contact portion 47*a* is formed curvedly: in the way that makes the initial-stage contact portion 47*a* situated more forward in the movement direction 52 of the contact surface 47 as the initial-state contact portion 47*a* comes closer to the rotary fulcrum of the lever 46 in the direction along the plane PL orthogonal to the movement direction 52; and in a way that makes the initial-stage contact portion 47*a* intersect the plane PL. The latter-stage contact portion 47*b* is formed along the plane PL.

A force F in the movement direction 52 of the contact surface 47 in response to the turning manipulation of the handle 23 acts, from the contact surface 47, on the lever 46 having the lever cover 48 brought into contact with the initial-stage contact portion 47*a* of the contact surface 47. The initial-stage contact portion 47*a* is formed curvedly: in the way that makes the initial-stage contact portion 47*a* situated more forward in the movement direction 52 of the contact surface 47 as the initial-stage contact portion 47*a* comes closer to the rotary fulcrum of the lever 46 in the direction along the plane PL orthogonal to the movement direction 52; and in the way that makes the initial-stage contact portion 47*a* intersect the plane PL. For these reasons, a component force R in a direction in which the lever 46 is turned occurs. A turning force M1 acting on the lever 46 due to the component force R becomes larger than a turning force M2 which would act on the lever 46 if the contact surface 47 were shaped like a flat surface orthogonal to the movement direction 52 of the contact surface 47.

A joint member 49 is attached to the other end portion of the lever main portion 46*a* in the lever 46. One end portion of a rod (not illustrated) is connected to the joint member 49, the rod configured to transmit a door opening operation force to a latch mechanism 53 (see FIG. 2) provided in the ingress/egress door 21.

Figure 3:
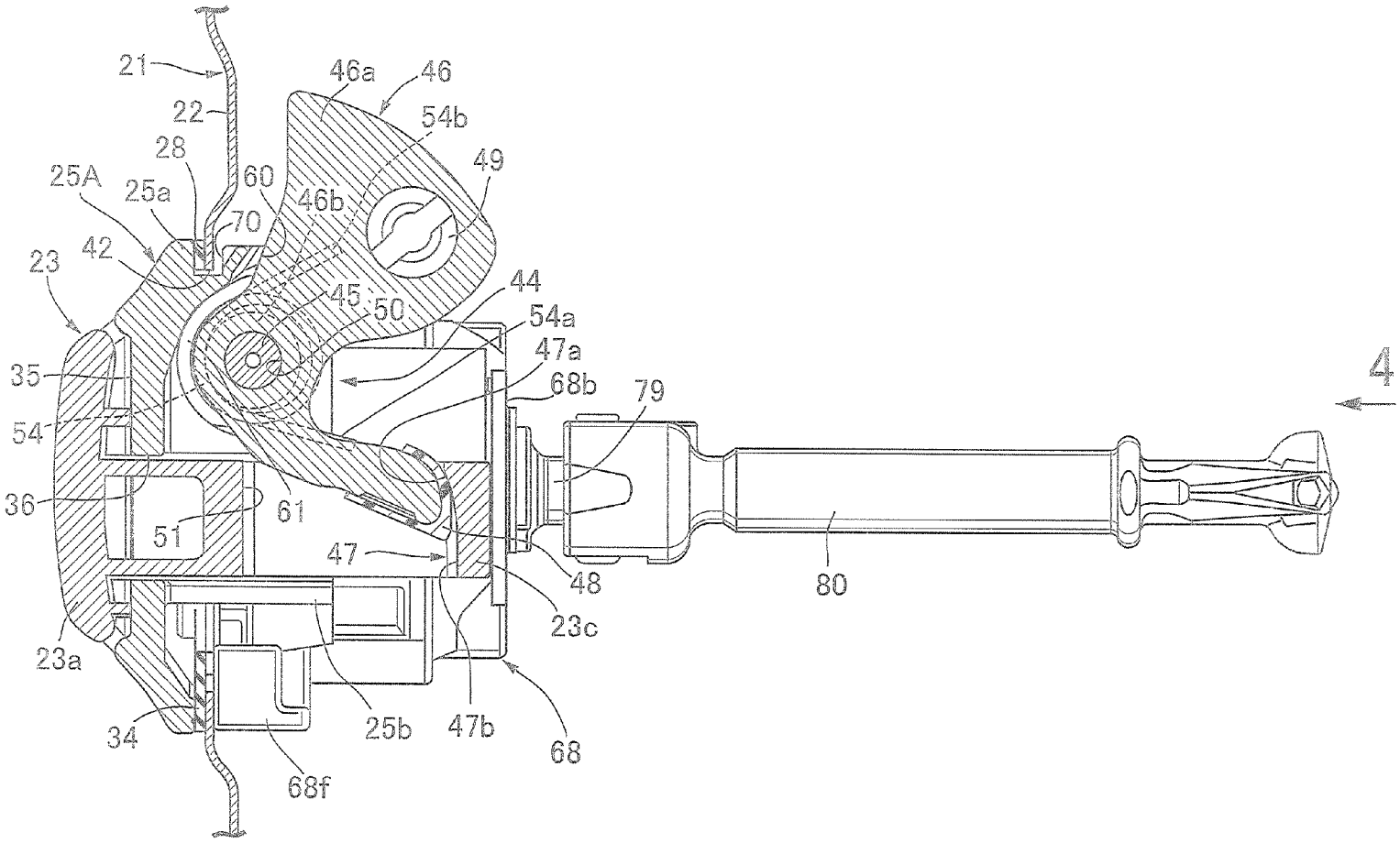
FIG. 3 is an enlarged sectional view taken along a line 3-3 in FIG. 1. (First Embodiment)
Figure 4:
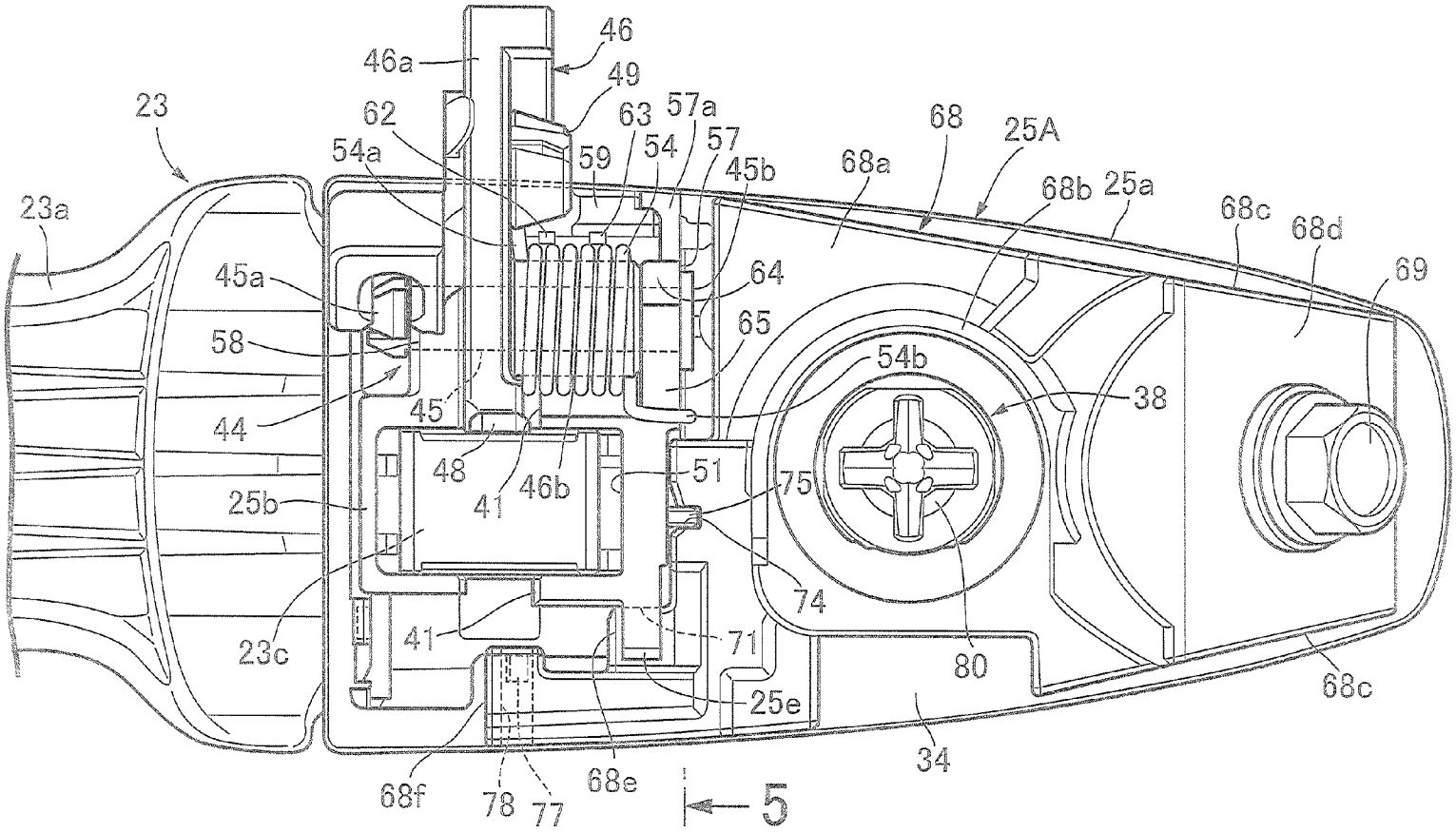
FIG. 4 is a view seen from an arrow 4 in FIG. 3 in a state where an outer panel is omitted. (First Embodiment)

While the cylinder lock 38 is in a state of being unlocked, the lever 46 is at an inactive position shown in FIG. 3 as long as the handle 23 is not operated. During this time, the closed state of the ingress/egress door 21 is maintained by the latch mechanism 53. Meanwhile, when the lever 46 turns clockwise from the position of FIG. 3 by an action of the guide arm portion 23*c* which is caused by operating the handle 23 and thereby causing the other end portion of the handle 23 to move away from the receiving recess portion 35 of the second base member 25A, the latch mechanism 53 cancels the closed state of the ingress/egress door 21, and the ingress/egress door 21 becomes able to be set open by the manipulation of the handle 23.

A return spring 54 being a torsion spring surrounding the supporting tube portion 46*b* of the lever 46 is provided between the lever 46 and the lever supporting portion 44. The lever 46 having the lever cover 48 brought into contact with the contact surface 47 is biased toward the inactive position by the spring force of the return spring 54, and the handle 23 is thereby spring-biased toward an open position by the return spring 54.

The lever supporting portion 44 is provided in the second base member 25A in a way that makes the lever supporting portion 44 continuous with the guide portion 25*b*. The lever supporting portion 44 is formed of a pair of side walls 57, 58 which are disposed on opposite sides of the lever 46 and which are respectively provided with coaxial supporting holes 55, 56 for inserting and supporting opposite end portions of the pivot 45 penetrating the pivot hole 50 provided in the lever 46. The side walls 57, 58 are provided continuously and integrally to the guide portion 25*b* at a right angle.

Figure 9:
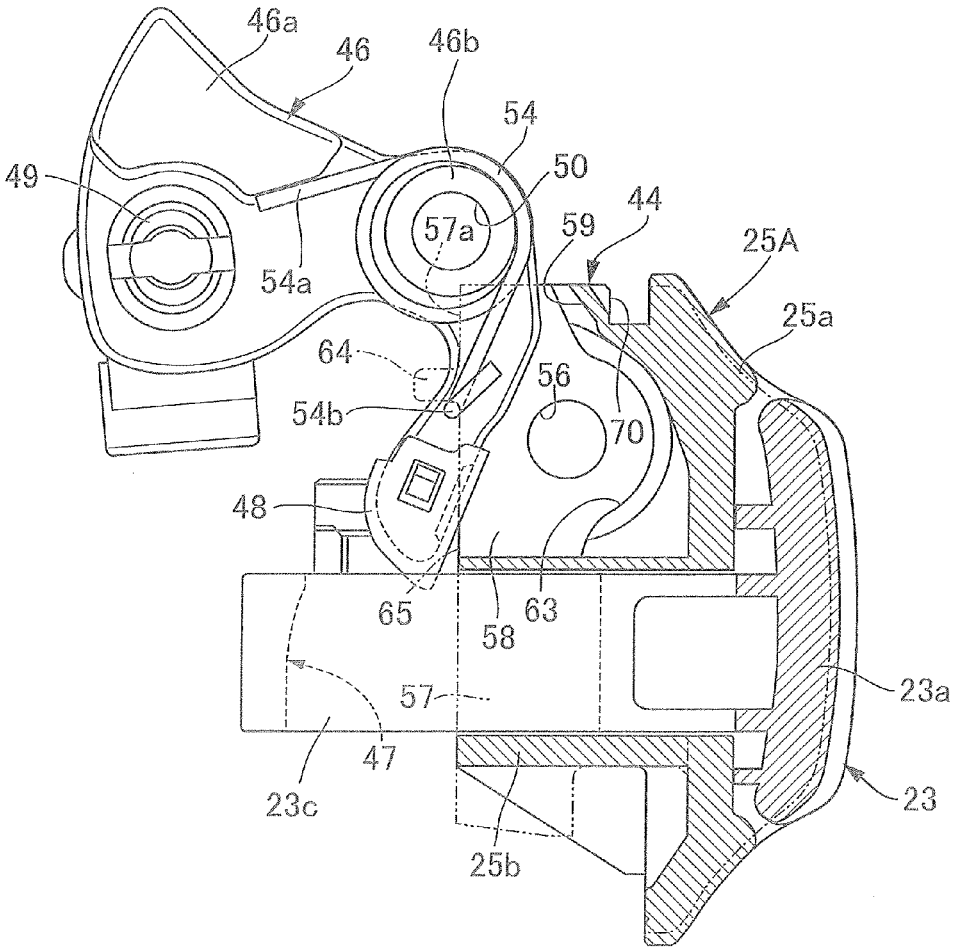
FIG. 9 is a sectional view taken along a line 9-9 in FIG. 7 which shows a state where the lever, to which a return spring is attached, is in the process of being assembled to the second base member. (First Embodiment)

An assembly guide portion 59 is provided between both side walls 57, 58 on a side opposite from the guide portion 25*b*. As shown in FIG. 9, the assembly guide portion 59 guides the manner in which the lever 46, to which the return spring 54 is assembled with one end portion 54*a* of the return spring 54 engaging with the lever 46, is pushed into a space between both side walls 57, 58 with the other end portion 54*b* of the return spring 54 engaging with one 57 of the side walls 57, 58, and with the one end portion of the lever 46 coming in contact with the contact surface 47.

Three stoppers 61, 62, 63, for example, disposed at intervals between both side walls 57, 58, are provided in the second base member 25A, between both side walls 57, 58. When the lever 46 pushed into the space between both side walls 57, 58 comes into contact with the stoppers 61 to 63 and the pushing movement is thereby restricted, the lever 46 is situated at such a position that the pivot hole 50 thereof corresponds to the supporting holes 55, 56 of the two respective side walls 57, 58. The stopper 61, which is one of the three stoppers 61 to 63, is formed in a way that makes the stopper 61 protrude in an arc shape in order to bring the stopper 61 into contact with the lever main portion 46*a* in the lever 46, and the other two stoppers 62, 63 are formed in a way that makes the stoppers 62, 63 protrude in an arc shape in order to bring the stoppers 62, 63 into contact with a portion of the return spring 54 which surrounds the supporting tube portion 46*b* of the lever 46.

In the state where the pushing of the lever 46 is restricted by the stoppers 61 to 63, the pivot 45 is sequentially inserted from the side wall 57 into the supporting hole 55 of the one side wall 57, the pivot hole 50 of the lever 46, and the supporting hole 56 of the other side wall 58. In this respect, the side wall 57 is one of the side walls 57, 58, and is located close to the tube portion 25*d* which is provided in the second base member 25A in a way that makes the tube portion 25*d* continuous with the cylinder lock 38. Multiple, for example, three engagement pieces 45*a* . . . separated in a peripheral direction are provided integrally to the one end portion of the pivot 45. When the pivot 45 is inserted into the pivot hole 50 and both supporting holes 55, 56, the diameter of the engagement pieces 45*a* . . . can be reduced to make an insertion operation easy. Meanwhile, in the state where the pivot 45 juts out from the other side wall 58, the diameter of the engagement pieces 45*a* . . . expands, and the engagement pieces 45*a* . . . engage with the outer side surface of the other side wall 58. Moreover, an engagement flange portion 45*b* engaging with the outer side surface of the one side wall 57 is provided integrally to the other end of the pivot 45 in a way that the engagement flange portion 45*b* project outward in a radial direction.

In the state where the lever 46 is turnably supported by both side walls 57, 58 via the pivot 45, gaps are formed between the lever 46 and the return spring 54, and the stoppers 61 to 63. Hence, when the lever 46 is turned, no friction occurs between the lever 46 and the stopper 61, and between the return spring 54 and each of the stoppers 62, 63.

Moreover, a turn position of the lever 46, which is pushed into the space between both side walls 57, 58 until being restricted by the stopper 61 to 63, and which is turned and biased by the spring force exerted by the return spring 54, is restricted by the contact of the lever cover 48 in the one end portion of the lever 46 with the contact surface 47 which is formed in the guide arm portion 23*c* of the handle 23, and by the contact of the lever 46 with a restriction portion 60 which is provided in the second base member 25A in a way that makes the restriction portion 60 adjacent to the assembly guide portion 59.

The other end portion 54*b* of the return spring 54 is engaged with the side wall 57 which is one of the side walls 57, 58. A protrusion 64 and a spring supporting portion 65 are provided in the one side wall 57. The protrusion 64 hooks the other end portion 54*b* of the return spring 54 when the lever 46, to which the return spring 54 is assembled, is pushed into the space between both side walls 57, 58 while being guided by the assembly guide portion 59, as shown in FIG. 9. The spring supporting portion 65 makes the other end portion 54*b* of the return spring 54 slide while maintaining its engagement state. In this respect, the other end portion 54*b* is unhooked from the protrusion 64 as the lever 46 is pushed into the space between both side walls 57, 58 while being guided by the assembly guide portion 59.

Figure 5:
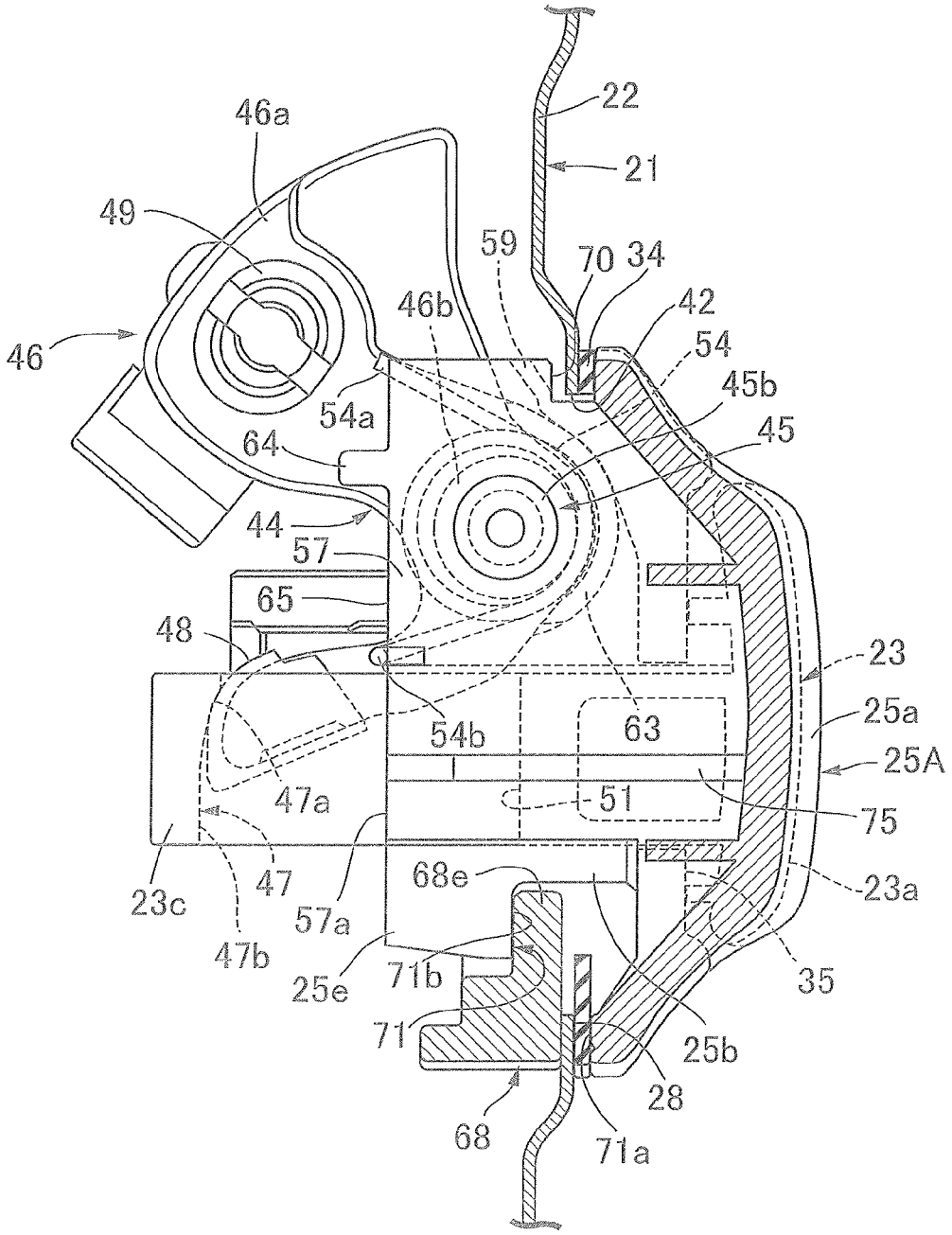
FIG. 5 is a sectional view taken along a line 5-5 in FIG. 4 in a state where a second base member is attached to the outer panel. (First Embodiment)
Figure 6:
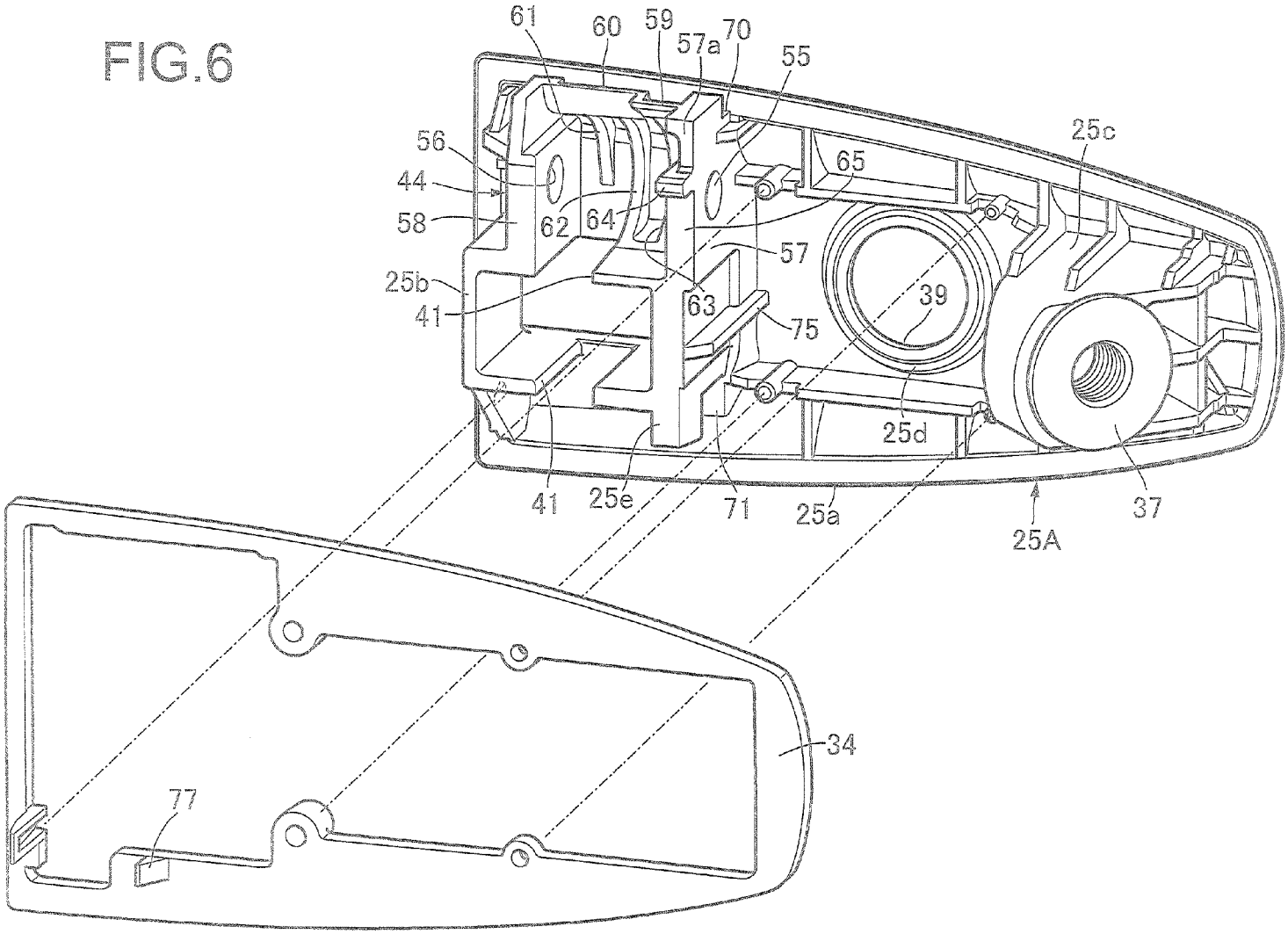
FIG. 6 is an exploded perspective view of the second base member and a second sealing member. (First Embodiment)
Figure 7:
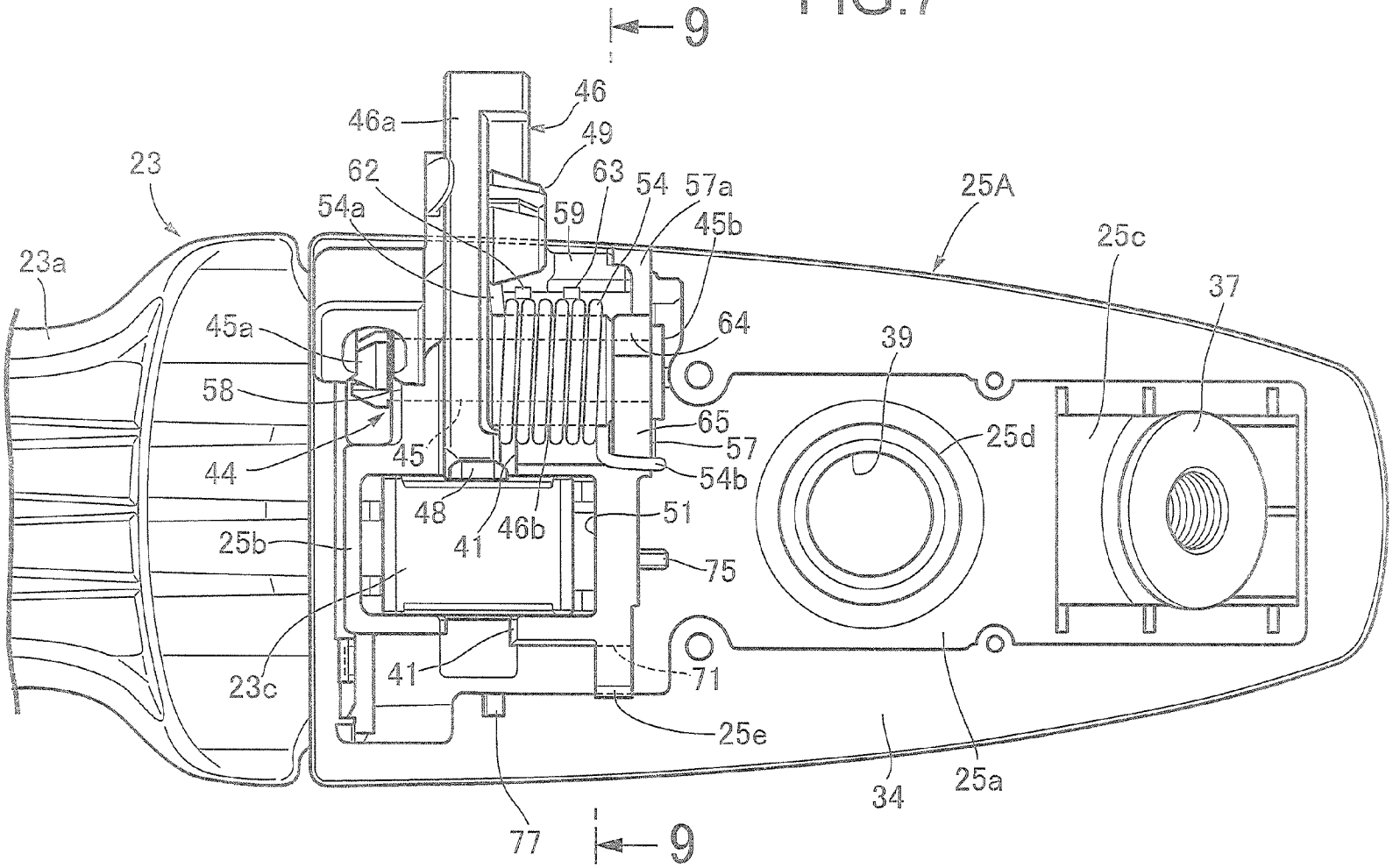
FIG. 7 is a view showing a state where an attachment member is removed from FIG. 4. (First Embodiment)

Incidentally, both side walls 57, 58 are provided in the way that makes the side walls 57, 58 protrude from the base member main portion 25*a* of the base member 25A at a substantially right angle. In a protruding end portion 57*a* of the one side wall 57 which protrudes from the base member main portion 25*a*, the protrusion 64 located in an intermediate portion between the guide portion 25*b* and the assembly guide portion 59 is provided in a way that makes the protrusion 64 protrude in a direction opposite from the base member main portion 25*a*. The spring supporting portion 65 is formed in the protruding end portion 57*a* of the one side wall 57, stretching between the protrusion 64 and the guide portion 25*b*. In the state where the lever 46 is pushed into the space between both side walls 57, 58 until coming into contact with the stoppers 61 to 63, as shown in FIG. 5, the other end portion 54*b* of the return spring 54 is engaged with an end portion, on the guide portion 25*b* side, of the spring supporting portion 65.

In addition, the other end portion 54*b* of the return spring 54 is formed in a way that makes the other end portion 54*b* bent like a substantially U-shape in order that an intermediate portion thereof can be brought into contact with the spring supporting portion 65 and engage with the outer side surface of the one side wall 57. The other end portion 54*b* can slide while being in contact with the spring supporting portion 65. The engagement of the other end portion 54*a* with the outer surface of the side wall 57 inhibits the fall of the return spring 54 to the inner side of the side wall 57 during its sliding.

Incidentally, the second base member 25A is attached to the outer panel 22 by fastening an attachment member 68 to the second base member 25A with the second sealing member 34 and the outer panel 22 interposed between the attachment member 68 and the base member main portion 25*a* of the second base member 25A by screwing a second bolt 69, which is inserted into the attachment member 68, to the second nut 37 of the second base member 25A.

A fitting groove 70 is provided to one of upper and lower portions of the second base member 25A, while an engagement groove 71 is provided to the other of the upper and lower portions of the second base member 25A, in order for the second base member 25A to be attached to the outer panel 22. An edge portion of the through-hole provided in the outer panel 22 is fitted into the fitting groove 70 with at least the guide portion 25*b* inserted therein. The engagement groove 71 is opened on a side opposite to an opening direction of the fitting groove 70.

In the embodiment, the fitting groove 70, which is opened upward in order for an upper edge portion of the second through-hole 42 together with the second sealing member 34 to be fitted into the fitting groove 70, is provided in the second base member 25A in a way that makes the fitting groove 70 disposed between the base member main portion 25*a*, and the assembly guide portion 59 and the restriction portion 60, the second through-hole 42 provided in the outer panel 22 in such a manner that only the guide portion 25*b* is inserted therein. Moreover, the assembly guide portion 59 is provided in the second base member 25A in a way that makes the assembly guide portion 59 extend to an inner side of the vehicle and toward above the upper edge portion of the second through-hole 42 fitted to the fitting groove 70. The assembly guide portion 59 covers, from above, at least a portion, on the outer panel 22 side, of the return spring 54, in the state where the second base member 25A is attached to the ingress/egress door 21.

The engagement groove 71 is provided in the lower portion of the second base member 25A in a way that makes the engagement groove 71 open downward between the base member main portion 25*a* and a protrusion 25*e* which integrally protrudes downward from a tip end of a lower portion of the guide portion 25*b*. A lower end of a side wall 71*a*, on a base member main portion 25*a* side, of the engagement groove 71 is at a position below a lower edge portion of the second through-hole 42 in the outer panel 22. A lower end of a side wall 71*b*, on a protrusion 25*e* side, of the engagement groove 71 is at a position above the lower edge portion of the second through-hole 42.

Figure 10:
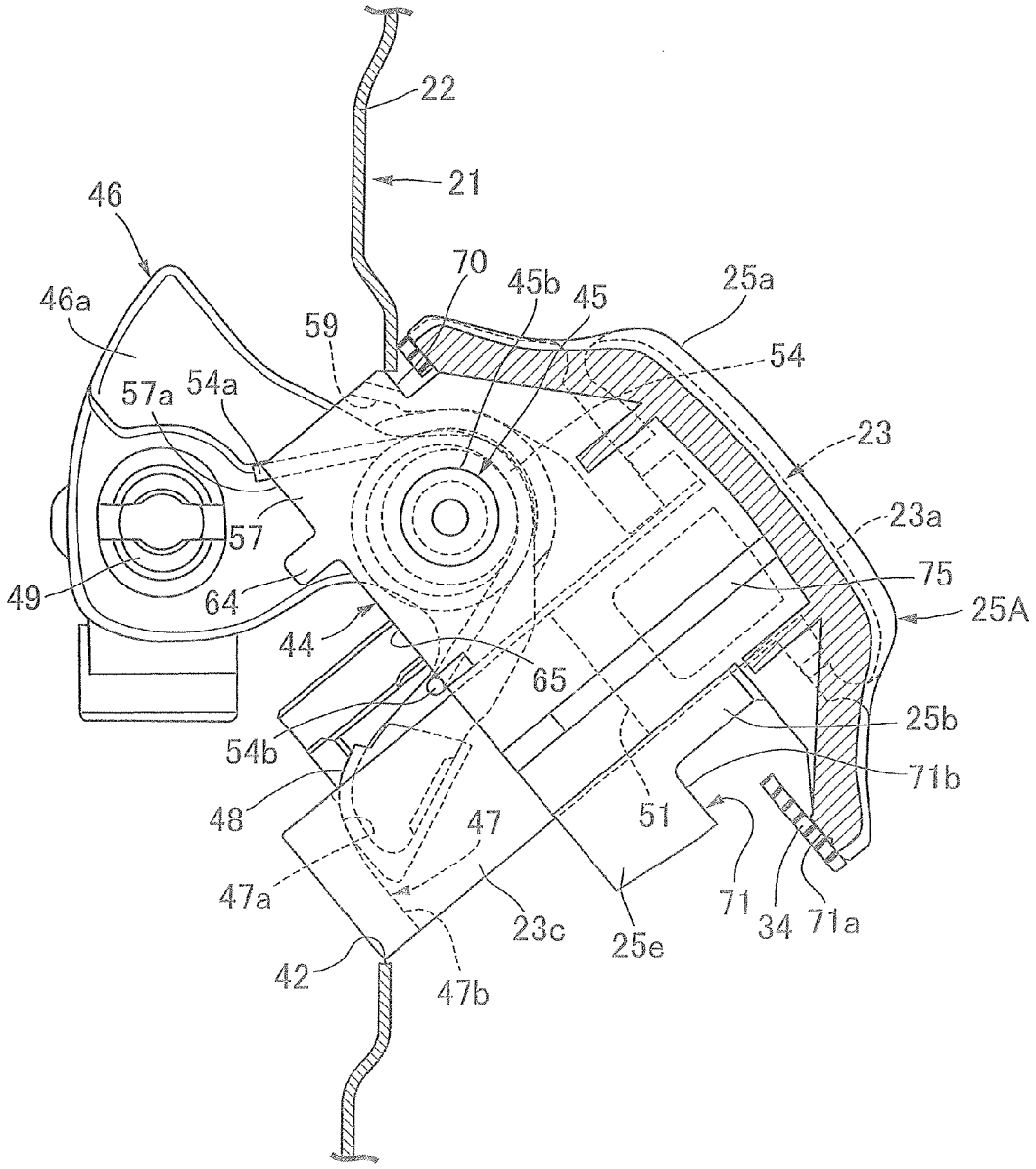
FIG. 10 is a sectional view corresponding to FIG. 5 in order to show a state where the second base member is in the process of being attached to the outer panel. (First Embodiment)

Meanwhile, the second base member 25A, to which the lever 46 with the return spring 54 mounted to the lever 46 is assembled and in which the guide arm portion 23*c* of the handle 23 is inserted into the insertion hole 36 and the guide portion 25*b*, is assembled to the outer panel 22 side as follows. As shown in FIG. 10, in a posture where the handle 23 is inclined to be at an upper position, the upper edge portion of the second through-hole 42 and the second sealing member 34 are fitted to the fitting groove 70 from above, while the guide portion 25*b* is inserted into the second through-hole 42 from an obliquely downward direction. At the same time, the tube portion 25*d* and the nut supporting portion 25*c* are inserted into the third through-hole 43. The width of the fitting groove 70 is set to be larger than the total value of the thickness of the outer panel 22 and the thickness of the second sealing member 34 so as to meet the change in posture of the second base member 25A during the assembly. Hence, a gap as shown in FIG. 5 is formed between the inner surface of the outer panel 22 and the inner side surface of the fitting groove 70 with the second sealing member 34 interposed between the base member main portion 25*a* of the second base member 25A and the outer surface of the outer panel 22.

Figure 11:
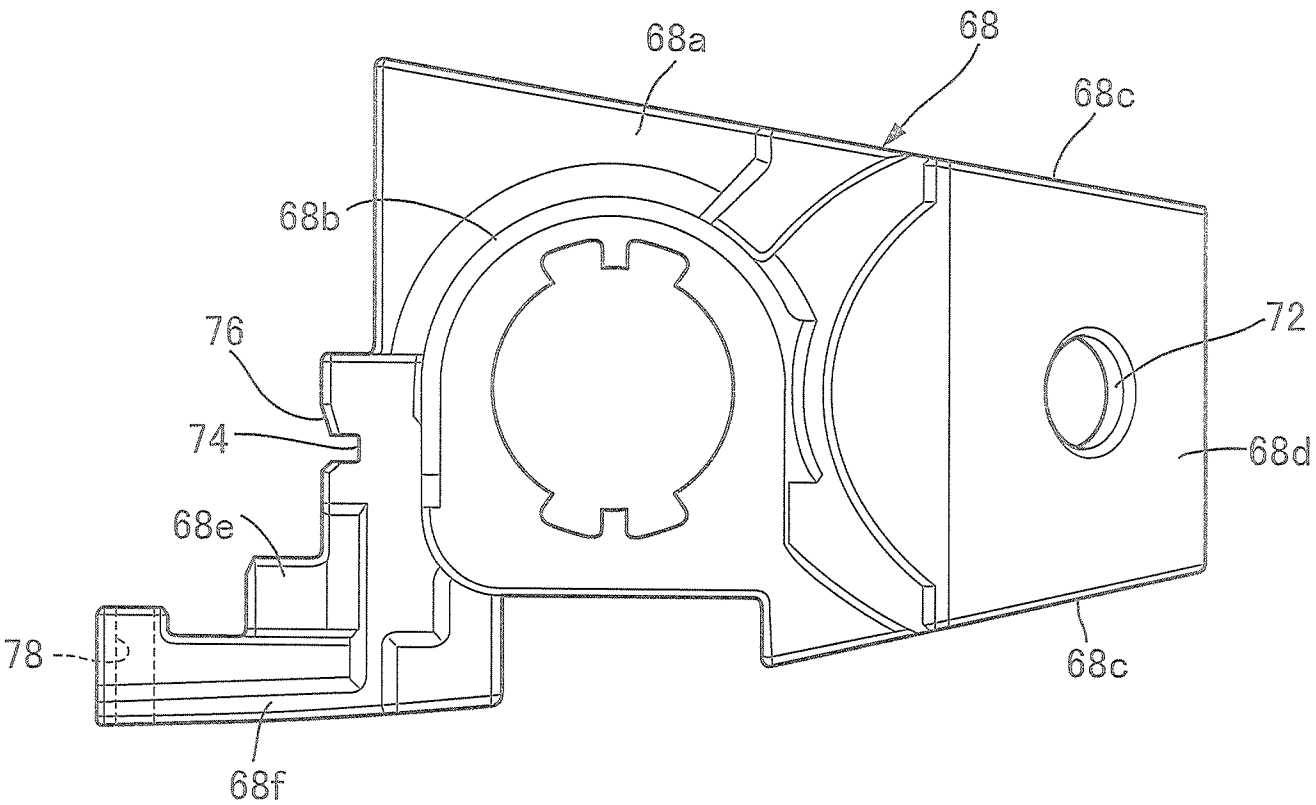
FIG. 11 is a front view of the attachment member. (First Embodiment)
Figure 12:
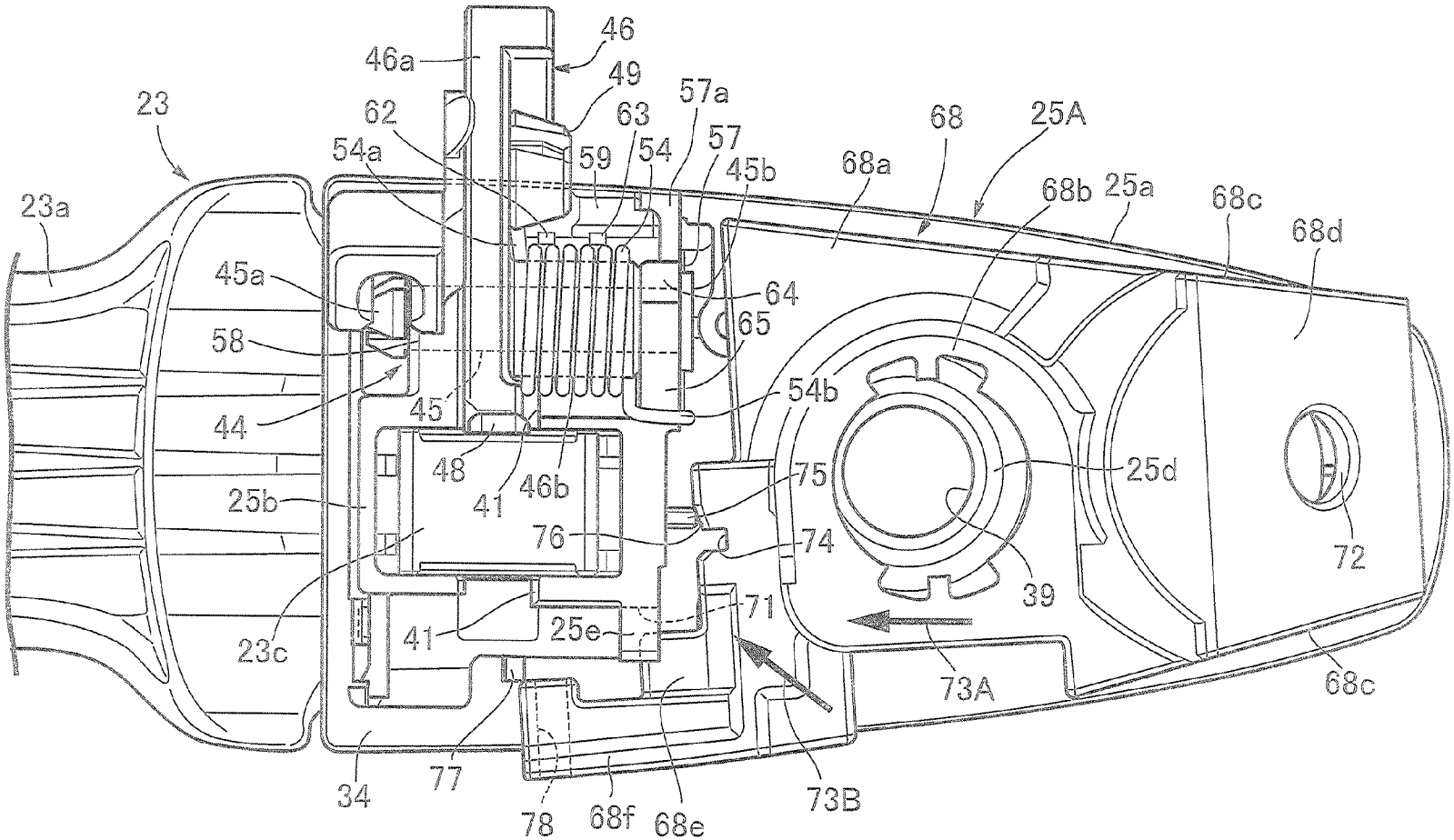
FIG. 12 is a view corresponding to FIG. 4 in order to show a state where the attachment member is in the process of being temporary assembled to the second base member. (First Embodiment)
Figure 13:
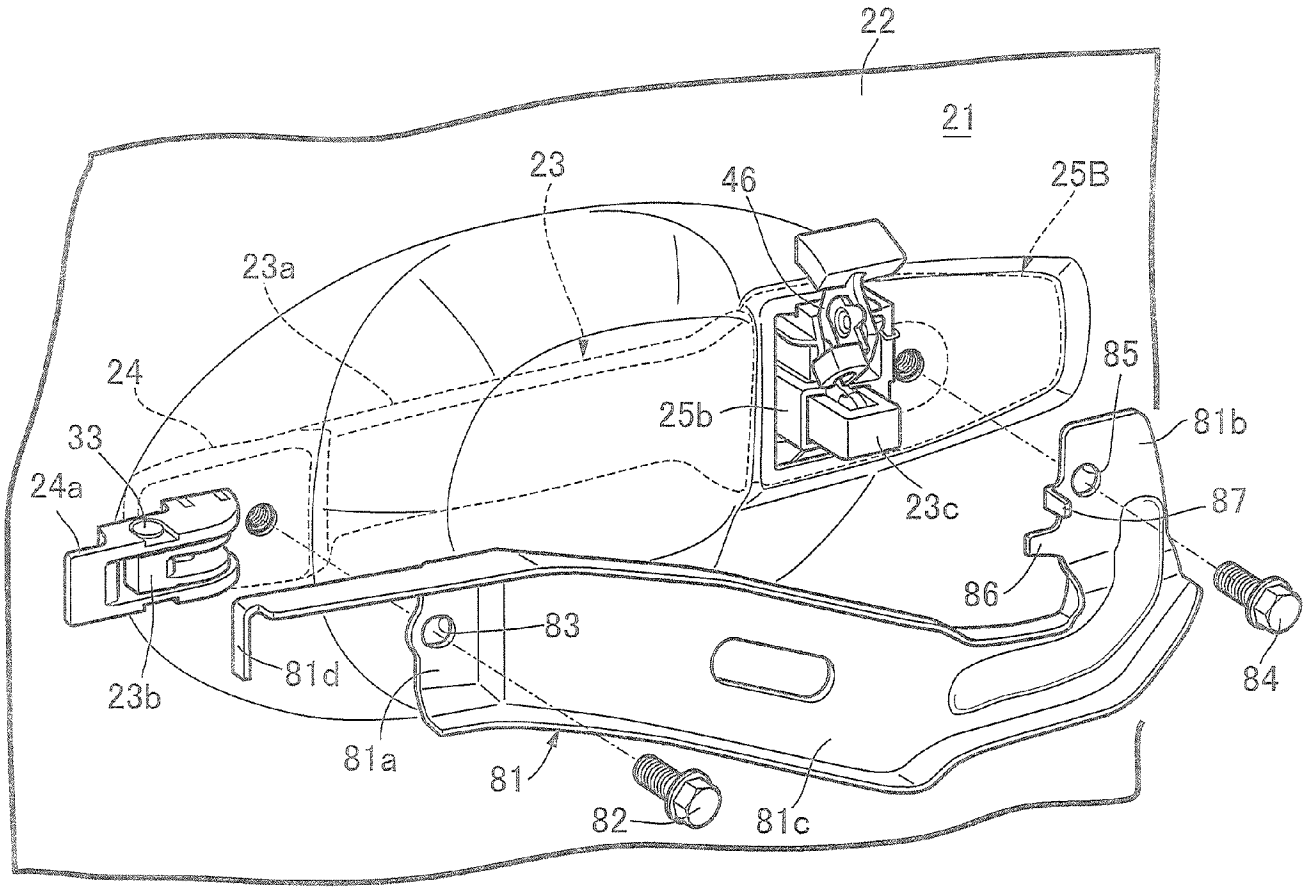
FIG. 13 is a perspective view showing a second embodiment, in which a state where an attachment member is removed is seen from inside of an outer panel. (Second Embodiment)
Figure 14:
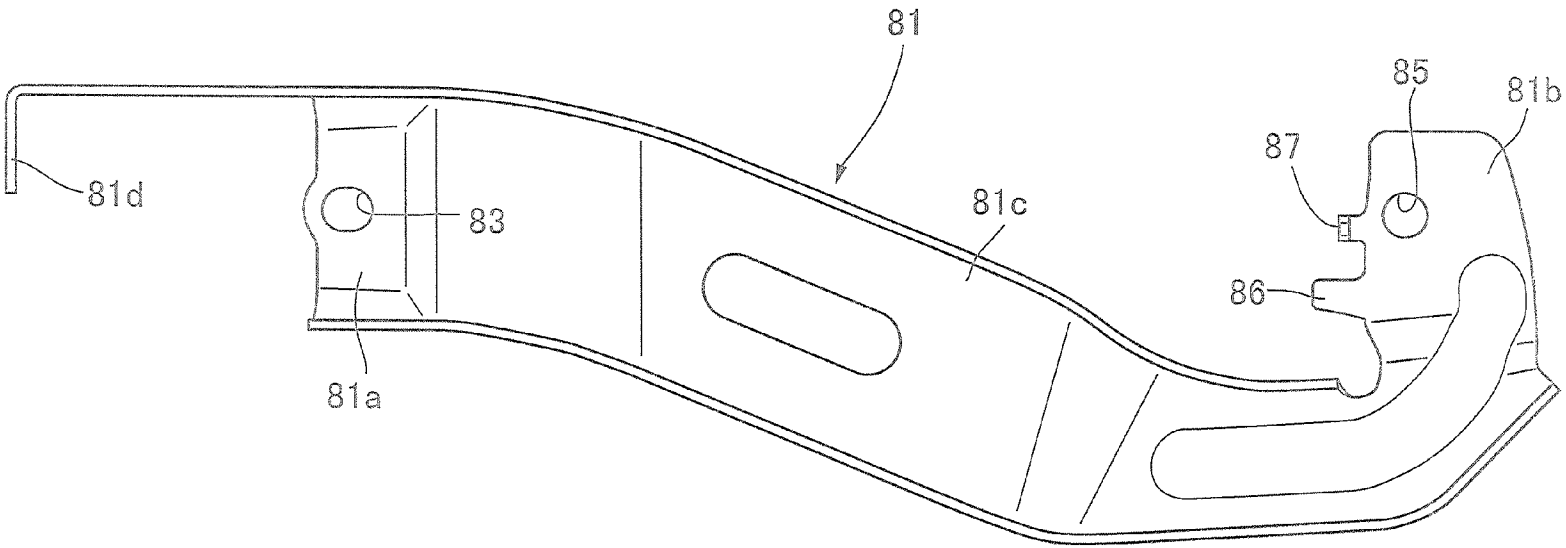
FIG. 14 is a front view of the attachment member. (Second Embodiment)
Figure 15:
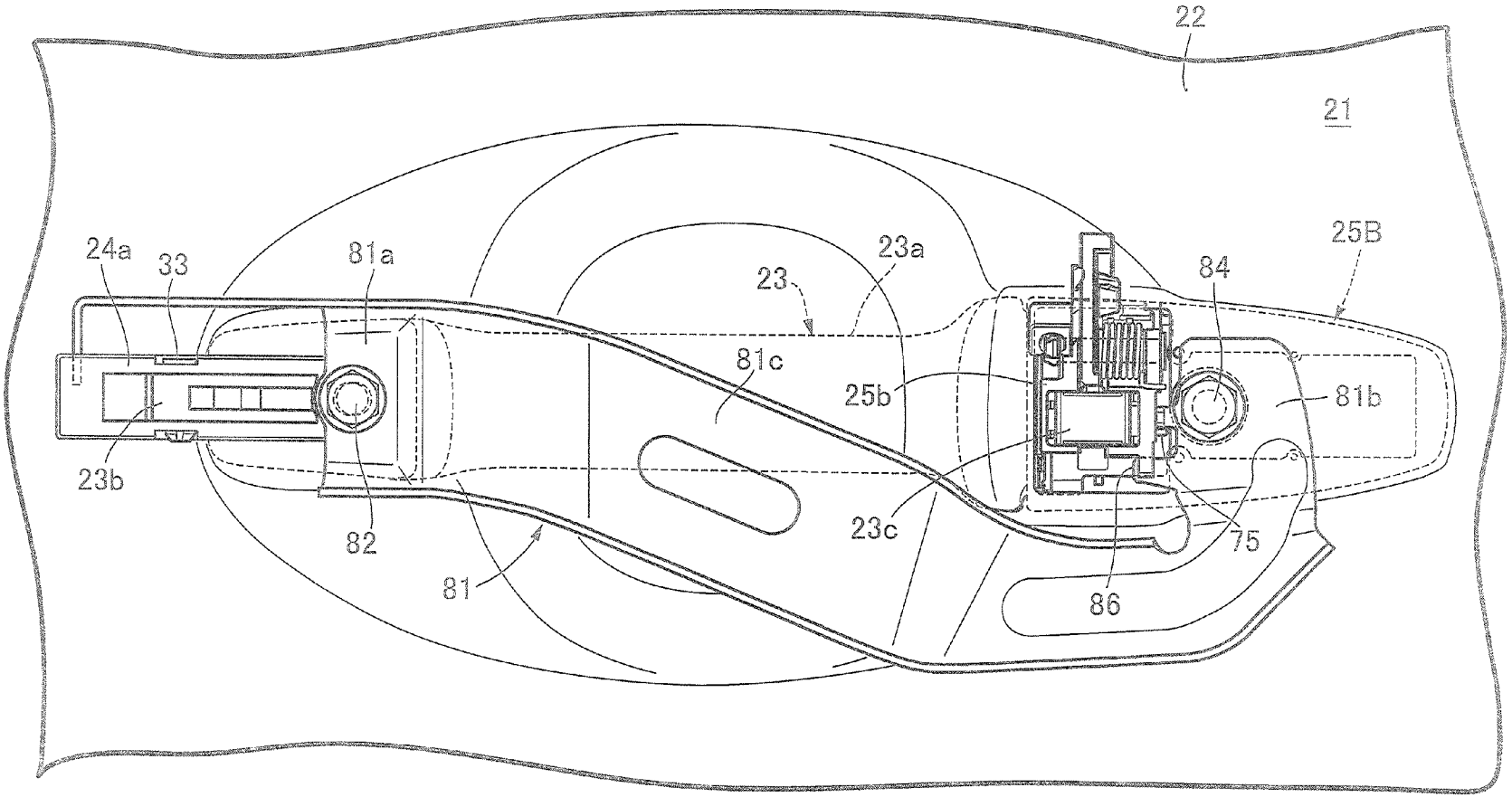
FIG. 15 is a view in which a state where the attachment member is fastened to first and second base members is seen from inside of the outer panel. (Second Embodiment)
Figure 16:
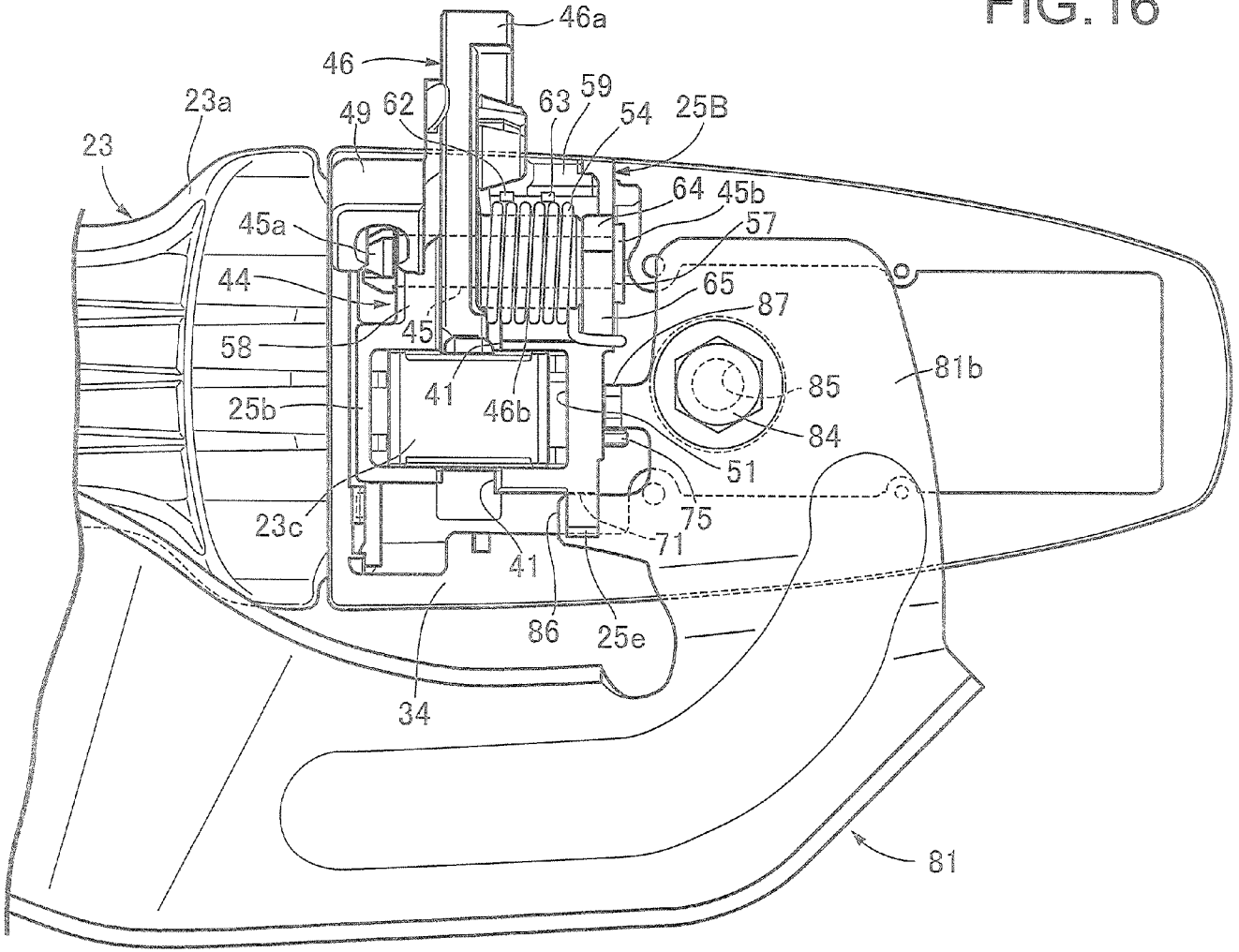
FIG. 16 is an enlarged view of an essential portion of FIG. 15, which shows a structure for connecting the attachment member to the second base member side in an enlarged manner. (Second Embodiment)
Figure 17:
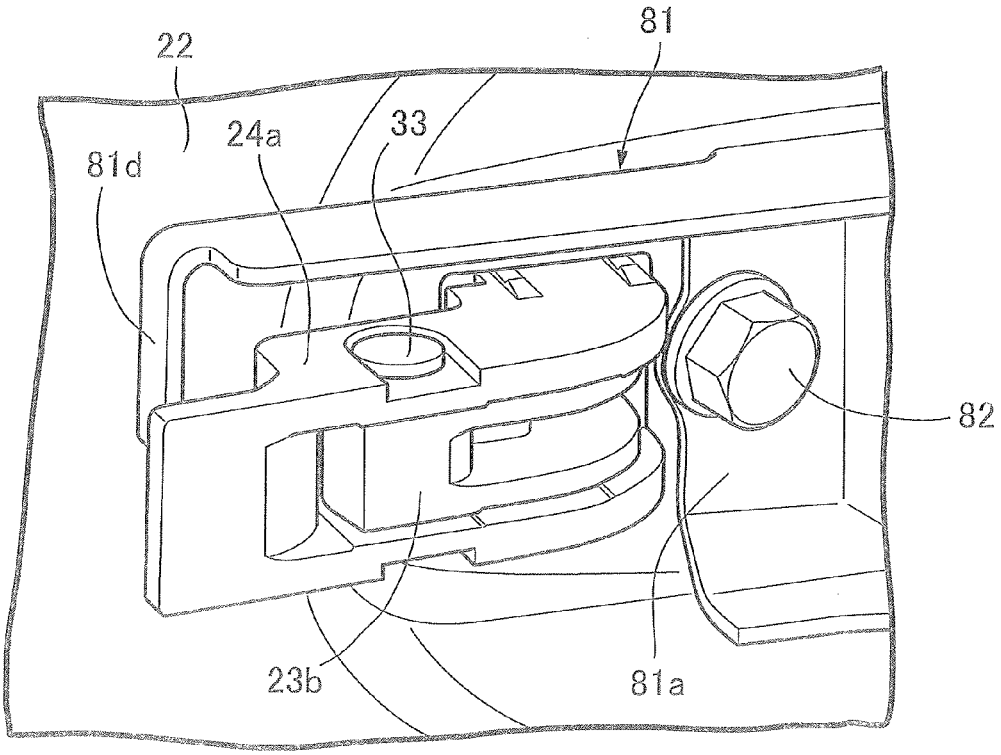
FIG. 17 is a perspective view showing a structure for connecting the attachment member to the first base member in an enlarged manner. (Second Embodiment)

Referring also to FIG. 11, the attachment member 68 integrally includes a flat surface portion 68*a*, a tubular cylinder lock attachment portion 68*b*, a pair of upper and lower wall portions 68*c*, 68*c*, a fastening plate portion 68*d*, an engagement protruding portion 68*e*, and an extending arm portion 68*f*. The flat surface portion 68*a* comes into contact with a back surface of the outer panel 22 around the third through-hole 43. The cylinder lock attachment portion 68*b* is continuous with the flat surface portion 68*a* at a right angle in order for the cylinder lock 38 to be attached to the cylinder lock attachment portion 68*b* while protectingly surrounding the cylinder lock 38. The wall portions 68*c*, 68*c* are formed in a way that sandwiches the nut supporting portion 25*c* of the second base member 25A from above and below, and are continuous with the flat surface portion 68*a* at a right angle, as well as are continuous with the cylinder lock attachment portion 68*b*. The fastening plate portion 68*d* is formed in a way that makes the fastening plate portion 68*d* face the second nut 37 which is mold-joined to the nut supporting portion 25*c* of the second base member 25A, and integrally connects tip ends of both side wall portions 68*c* . . . . The engagement protruding portion 68*e* protrudes forward from a lower portion of the flat surface portion 68*a* in order to engage with the engagement groove 71. The extending arm portion 68*f* extends forward from a lowermost portion of the flat surface portion 68*a* in a way that makes the extending arm portion 68*f* protrude further forward of the engagement protruding portion 68*e* while being continuous with a lower portion of the engagement protruding portion 68*e*. The engagement protruding portion 68*e* is slidingly inserted in the engagement groove 71 in a way that makes the engagement protruding portion 68*e* slide along the side wall 71*b*, on the protruding portion 25*e* side.

A bolt insertion hole 72 in which to insert the second bolt 69 to be screwed to the second nut 37 is provided in the fastening plate portion 68*d*. Moreover, while the second sealing member 34 and the outer panel 22 are in a state of being interposed between the engagement protruding portion 68*e* and the base member main portion 25*a* of the second base member 25A, the engagement protruding portion 68*e* is engaged with the engagement groove 71 by making the attachment member 68 slide from the right to the left in FIG. 12 as shown by an arrow 73A of FIG. 12, i.e. from the rear to the front in the front-rear direction of the vehicle, or by making the attachment member 68, which takes a posture inclined slightly downward toward the front, slide obliquely upward toward the front from below as shown in an arrow 73B of FIG. 12, with the flat surface portion 68*a* in slide contact with the back surface of the outer panel 22.

Moreover, a position of the attachment member 68 relative to the second base member 25A in an up-down direction is restricted when the engagement protruding portion 68*e* is engaged with the engagement groove 71. A position restriction recess portion 74 is provided in one of the second base member 25A and the attachment member 68, while a position restriction protruding portion 75 is provided in the other one of the second base member 25A and the attachment member 68, for the purpose of restricting the relative position of the attachment member 68 in the up-down direction. The position restriction recess portion 74 is opened in one horizontal direction. The position restriction protruding portion 75 engages with the position restriction recess portion 74 when the attachment member 68 engages with the engagement groove 71, and thereby restricts the position of the attachment member 68 relative to the second base member 25A in the up-down direction.

In the embodiment, the position restriction recess portion 74 is provided on a side surface, on a guide portion 25*b* side of the second base member 25A, of the flat surface portion 68*a* of the attachment member 68, while the position restriction protruding portion 75 is provided in the guide portion 25*b* of the second base member 25A. In addition, an inclined surface 76 is formed on a side surface of the flat surface portion 68*a* which faces the guide portion 25*b* at a position above the position restriction recess portion 74. The inclined surface 76 guides the restriction protruding portion 75 to the position restriction recess portion 74 side by making a tip end of the position restriction protruding portion 75 in slide contact therewith, when the attachment member 68 is made to slide with the engagement protruding portion 68*e* engaged with the engagement groove 71.

A restriction protruding portion 77 for restricting the movement of the attachment member 68 in a sliding direction in which the engagement protruding portion 68*e* engages with the engagement groove 71 is projectingly provided to a back surface of a lower portion of the second sealing member 34. A restriction groove 78 with which the restriction protruding portion 77 is engaged is provided in a tip end portion of the extending arm portion 68*f*.

By causing the attachment member 68 to slide in order for the engagement protruding portion 68*e* to be engaged with the engagement groove 71 with the second sealing member 34 and the outer panel 22 interposed between the engagement protruding portion 68*e* and the base member main portion 25*a*, a front end portion of the extending arm portion 68*f* goes over the restriction protruding portion 77, and the restriction protruding portion 77 is housed inside and engages with the restriction groove 78. In this event, a feeling of click of fitting the attachment member 68 is obtained. Hence, whether the sliding of the attachment member 68 is completed or not can be known sensibly. Moreover, since the restriction protruding portion 77 is provided in the second sealing member 34 made of the elastic material, the restriction protruding portion 77 is flexible. Accordingly, the restriction protruding portion 77 can be made larger to increase a restriction force, or to make it easier to sense the feeling of whether or not the sliding of the attachment member 68 is completed.

Figure 2:
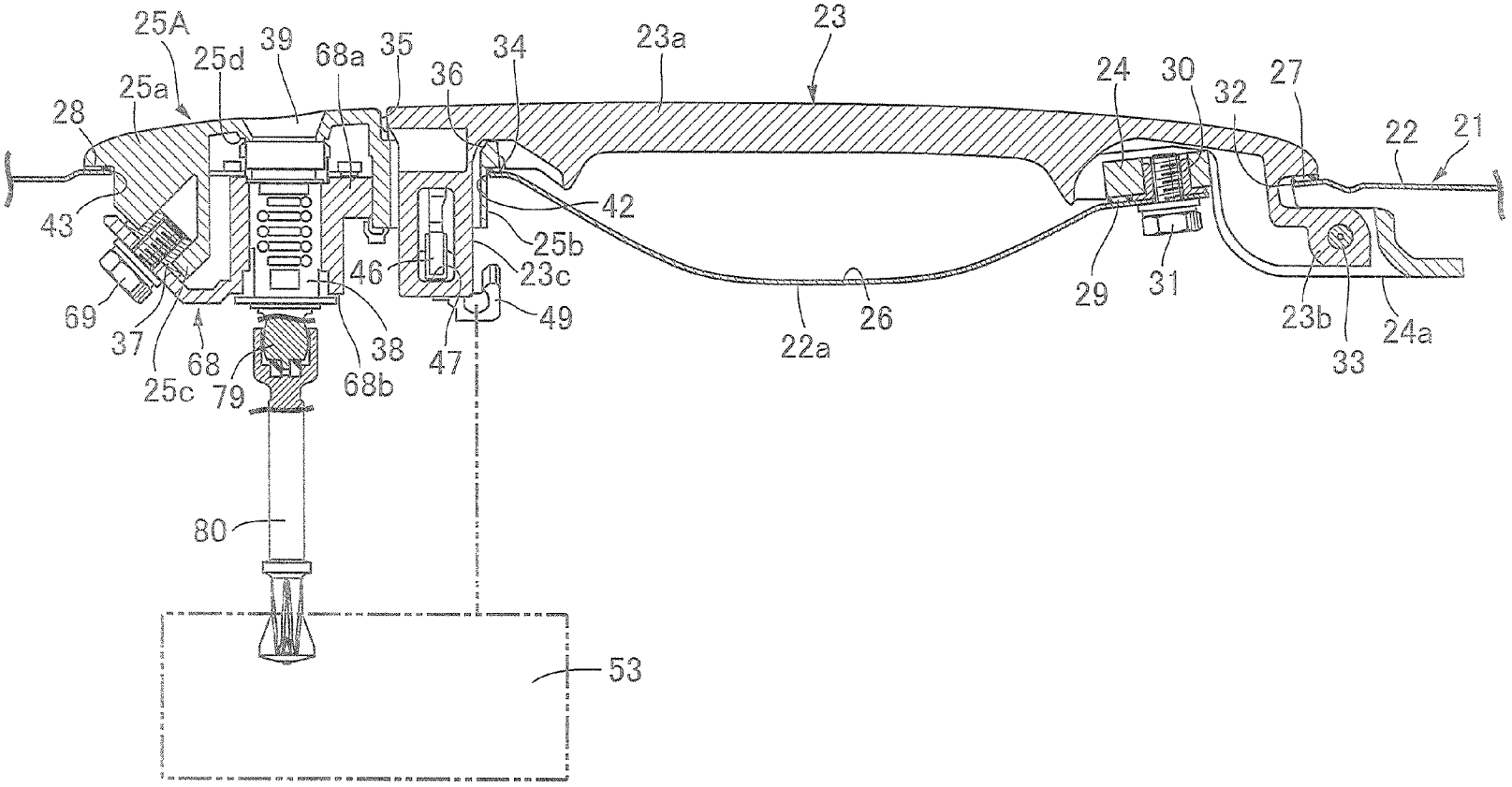
FIG. 2 is a sectional view taken along a line 2-2 in FIG. 1. (First Embodiment)

One end portion of a power transmission shaft 80 is attached to a rotor 79 of the cylinder lock 38 in a way that makes the one end portion thereof unrotatable relative to the rotor 79, the cylinder lock 38 being attached to the cylinder lock attachment portion 68*b* of the attachment member 68 by being inserted into the cylinder lock attachment portion 68*b*. The other end portion of the power transmission shaft 80 is connected to the latch mechanism 53, as shown in FIG. 2, in order to transmit a locking/unlocking operation force generated by an operation of the cylinder lock 38.

Next, operations of the first embodiment are described. The handle 23 for opening and closing the ingress/egress door 21 by a turning manipulation and the lever 46 for transmitting an unlock operation force to the latch mechanism 53 provided in the ingress/egress door 21 are turnably supported by the ingress/egress door 21. The one end portion of the lever 46 is in contact with the contact surface 47 formed in the handle 23 at a position offset from the rotary fulcrum of the handle 23, in a manner that makes the lever 46 perform the turning operation in response to the turning manipulation of the handle 23. In the contact surface 47, at least a portion, which comes into contact with the lever cover 48 in the one end portion of the lever 46 at the initial stage of the manipulation of the handle 23 toward an opening side of the ingress-egress door 21, is formed in the inclined manner or curvedly: in the way that makes the portion situated more forward in the movement direction 52, in which the contact surface 47 moves in response to the turn of the handle 23, as the portion comes closer to the rotary fulcrum of the lever 46 in the direction along the plane PL orthogonal to the movement direction 52; and in the way that makes the portion intersect the plane PL.

Accordingly, the rotary component force R which acts on the lever 46 from the contact surface 47 can be made larger than if the one end portion of the lever 46 would come into contact with a flat-shaped contact surface orthogonal to the movement direction 52 of the contact surface 47. In addition, the friction resistance force occurring between the lever 46 and the contact surface 47 is made relatively small. Hence, large rotating torque can be applied to the lever 46 with a small operation force. Reducing the manipulation load of the handle 23 at the initial stage of the action makes it possible to eliminate unsmoothness in the manipulation of the handle 23, and to improve the manipulation feeling of the handle 23.

Moreover, the contact surface 47 is formed of: the initial-stage contact portion 47*a* which comes into contact with the one end portion of the lever 46 at the initial stage of the manipulation of the handle 23, and which is formed in the inclined manner or curvedly in the way that makes the initial-stage contact portion 47*a* situated more forward in the movement direction 52 of the contact surface 47 as the initial-stage contact portion 47*a* comes closer to the rotary fulcrum of the lever 46 in the direction along the plane PL orthogonal to the movement direction 52, and in the way that makes the initial-stage contact portion 47*a* intersect the plane PL; and the latter-stage contact portion 47*b* which is formed along the plane, and which is continuous with the initial-stage contact portion 47*a* in the way that makes the latter-stage contact portion 47*b* come into contact with the one end portion of the lever 46 at the latter stage of the manipulation of the handle 23. Hence, after the initial-stage of the manipulation of the handle 23, a lever ratio increases due to the displacement of the contact portion of the lever 46 with the contact surface 47, and rotating torque larger than that in the initial-stage of the manipulation can be applied to the lever 46. Bringing the one end portion of the lever 46 in contact with the latter-stage contact portion 47*b* in the contact surface 47 which extends along the plane PL orthogonal to the movement direction 52 of the contact surface 47 makes it possible to reduce the change in the manipulation force of the handle 23, and to obtain smooth action feeling.

Furthermore, the contact surface 47 is formed on the tip end side of the guide arm portion 23*c* included in the handle 23; the lever supporting portion 44 turnably supporting the lever 46 via the pivot 45 is provided in the second base member 25A, which is attached to the outer panel 22 and has the insertion hole 36 in which to movably insert the guide arm portion 23*c*; and the return spring 54 turning and biasing the lever 46 in a direction in which the one end portion of the lever 46 is brought into contact with the contact surface 47 is provided between the lever supporting portion 44 and the lever 46. The lever supporting portion 44 is formed of the pair of side walls 57, 58 which are disposed respectively on opposite sides of the lever 46 and which respectively have the coaxial supporting holes 55, 56 for inserting and supporting opposite end portions of the pivot 45 penetrating the pivot hole 50 provided in the lever 46. The assembly guide portion 59 and the stoppers 61 to 63 are provided in second base member 25A while disposed between both side walls 57, 58. The assembly guide portion 59 guides the manner in which the lever 46, to which the return spring 54 is assembled with one end portion 54*a* of the return spring 54 engaging with the lever 46, is pushed into the space between both side walls 57, 58 with the other end portion 54*b* of the return spring 54 engaging with the side wall 57 which is one of the side walls 57, 58, and with the one end portion of the lever 46 coming in contact with the contact surface 47. The stoppers 61 to 63 restrict the lever 46 pushed into the space between the both side walls 57, 58, at the position that the pivot hole 50 corresponds to the supporting holes 55, 56 of both side walls 57, 58. The turning position of the lever 46 which is pushed into the space between the both side walls 57, 58 until being restricted by the stoppers 61 to 63 and which is turned and biased by the spring force exerted by the return spring 54 is restricted by the contact of the lever 46 with the contact surface 47 and the restriction portion 60 of the second base member 25A.

Accordingly, when the lever 46, which the return spring 54 is assembled with the one end portion 54*a* engaging with the lever 46, is installed in the lever supporting portion 44 formed of the pair of side walls 57, 58, the lever 46 can be pushed into the space between both side walls 57, 58 in the way that the other end portion 54*b* of the return spring 54 is made to engage with the side wall 57 which is one of the side walls 57, 58 with the one end portion of the lever 46 coming into contact with the contact surface 47 of the guide arm portion 23*c*, by guiding the lever 46 with the assembly guide portion 59 provided between the side walls 57, 58. Moreover, when the lever 46 pushed into the space is restricted by the stoppers 61 to 63, the pivot hole 50 of the lever 46 is at the position corresponding to the supporting holes 55, 56 of both side walls 57, 58, and the turning position of the lever 46, which is pushed into the space between both side walls 57, 58 until being restricted by the stoppers 61 to 63, is restricted by the contact of the lever 46 with the contact surface 47 and the second base member 25A. Hence, the pivot 45 can be inserted into the pivot hole 50 of the lever 46 and the supporting holes 55, 56 of both side walls 57, 58 with the hand removed from the lever 46. Thus, the work of assembling the lever 46 to the lever supporting portion 44 of the second base member 25A is easy, and the assemblability can be thereby improved.

In addition, the protrusion 64 and the spring supporting portion 65 are provided in the side wall 57 being one of the pair of side walls 57, 58 with which the other end portion 54*b* of the return spring 54 is engaged. The protrusion 64 hooks the other end portion 54*b* of the return spring 54 when the lever 46, to which the return spring 54 is assembled, is pushed into the space between both side walls 57, 58 while being guided by the assembly guide portion 59. The spring supporting portion 65 slides the other end portion 54*b* of the return spring 54, which is unhooked from the protrusion 64 as the lever 46 is pushed into the space between both side walls 57, 58 while being guided by the assembly guide portion 59, while maintaining the engaged state. Hence, the position of the engagement of the other end portion 54*b* of the return spring 54 with the side wall 57 can be shifted with the engagement between the return spring 54 and the side wall 57 maintained when the lever 46, to which the return spring 54 is assembled, is installed in the lever supporting portion 44. Thus, the work of assembling the lever 46 to the lever supporting portion 44 is made easier and the assemblability can be thereby improved.

Moreover, the assembly guide portion 59 is provided in the second base member 25A in the way that makes the assembly guide 59 cover, from above, at least a portion of the return spring 54 on the outer panel 22 side, while the second base member 25A is in the state of being attached to the ingress/egress door 21. Hence, even when the outer panel 22 of the ingress/egress door 21 is one which faces the outside of the vehicle as in the embodiment, the assembly guide portion 59 can prevent water drops running down the back surface of the outer panel 22 from falling on the return spring 54, and exert a waterproof mechanism.

Furthermore, the second base member 25A provided with the insertion hole 36, to which the guide arm portion 23*c* of the handle 23 is inserted, integrally includes: the base member main portion 25*a* having the insertion hole 36; and the guide portion 25*b* provided continuously with the base member main portion 25*a* in the way that makes the guide portion 25*b* guide the guide arm portion 23*c* which is inserted into the insertion hole 36. The fitting groove 70, in which the upper edge portion of the second through-hole 42 is fitted, is provided in one of the upper portion and the lower portion (the upper portion in the embodiment) of the second base member 25A, the second through-hole 42 provided in the outer panel 22 with at least the guide portion 25*b* inserted therein. The engagement groove 71 opened in the direction opposite to the opening direction of the fitting groove 70 is provided in the other one of the upper portion and the lower portion (the lower portion in the embodiment) of the second base member 25A. The attachment member 68, which can be fastened to the second base member 25A with the second sealing member 34 and the outer panel 22 interposed between the attachment member 68 and the base member main portion 25*a*, is engaged with the engagement groove 71 by sliding in contact with the back surface of the outer panel 22 while being restricted of the position relative to the second base member 25A in the up-down direction.

Accordingly, the second base member 25A and the attachment member 68 can be temporarily assembled to the outer panel 22 of the ingress/egress door 21. Hence, a worker is no longer required to perform work while holding the second base member 25A and the attachment member 68, and the second base member 25A can be attached to the outer panel 22 by fastening the attachment member 68 to the second base member 25A.

Moreover, the position restriction recess portion 74 opened in one horizontal direction is provided in one of the second base member 25A and the attachment member 68 (the attachment member 68 in the embodiment), while the position restriction protruding portion 75 is provided in the other one of the second base member 25A and the attachment member 68 (the second base member 25A in the embodiment), the position restriction protruding portion 75 engaging with the position restriction recess portion 74 when the attachment member 68 engages with the engagement groove 71 and thereby restricting the position of the attachment member 68 relative to the second base member 25A in the up-down direction. Hence, it is possible to restrict the position of the attachment member 68 relative to the second base member 25A in the up-down direction, and also to prevent the turn of the attachment member 68 in the fastening of the attachment member 68 to the second base member 25A. In addition, when the position of assembling the attachment member 68 relative to the second base member 25A is not correct, the position restriction protruding portion 75 cannot engage with the position restriction recess portion 74. Hence, the misalignment can be easily recognized.

Furthermore, the restriction protruding portion 77 is projectingly provided to the back surface of the second sealing member 34 interposed between the base member main portion 25*a* of the second base member 25A and the outer panel 22, the restriction protruding portion 77 engaging with the attachment member 68 so as to restrict the movement of the attachment member 68 in the sliding direction in which the engagement protruding portion 68*e* engages with engagement groove 71 while in slide contact with the back surface of the outer panel 22. Hence, the positions of the second base member 25A and the attachment member 68 relative to each other can be maintained more accurately.

Moreover, the cylinder lock attachment portion 68*b* protectingly surrounding the cylinder lock 38 is provided integrally to the attachment member 68 with the cylinder lock 38 attached to the cylinder lock attachment portion 68*b*. Thus, a malicious attack on the cylinder lock 38 on the inner side of the ingress/egress door 21 is made difficult, and the anti-theft quality can be thereby improved.

Second Embodiment

A second embodiment of the present invention is described while referring to FIGS. 13 to 17. Portions corresponding to those of the first embodiment described above are only illustrated while being denoted with the same reference numerals, and detailed descriptions thereof are omitted.

A first base member 24 having a handle supporting portion 24*a* is disposed on an outer panel 22 on one end side of a handle 23. The handle supporting portion 24*a* protrudes inward from the outer panel 22 to support a supporting arm portion 23*b* on the one end side of the handle 23. A second base member 25B is disposed on the outer panel 22 on the other end side of the handle 23. The second base member 25B has a guide portion 25*b*, in which a guide arm portion 23*c* on the other end side of the handle 23 is inserted, and turnably supports a lever 46. An attachment member 81 which is formed extending between opposite end portions of the handle 23 in a longitudinal direction thereof and which is disposed on a back-surface side of the outer panel 22 is fastened to the first and second base members 24, 25B with the outer panel 22 interposed between the attachment member 81 and the first and second base members 24, 25B.

The attachment member 81 is formed so as to integrally include: a front attachment portion 81*a* having an insertion hole 83 in which a bolt 82 to be fastened to the first base member 24 is inserted; a rear attachment portion 81*b* having an insertion hole 85 in which a bolt 84 to be fastened to the second base member 25B is inserted; and a connection portion 81*c* connecting the front and rear attachment portions 81*a*, 81*b*.

The rear attachment portion 81*b* is provided with an engagement protruding portion 86 engaging with an engagement groove 71 which is provided in a lower portion of the second base member 25B, like in the structure of the first embodiment in which the second base member 25A is attached to the outer panel 22 by using the attachment member 68.

Moreover, a protruding portion 87 is projectingly provided on the rear attachment portion 81*b*. The protruding portion 87 comes into contact and engages with a position restriction protruding portion 75 from above in order to restrict upward and downward movements of the rear attachment portion 81*b* relative to the second base member 25B while the engagement protruding portion 86 is in a state of engaging with the engagement groove 71, the position restriction protruding portion 75 projectingly provided to the guide portion 25*b* of the second base member 25B.

Furthermore, an engagement arm portion 81*d* is provided in a portion of the attachment member 81 which corresponds to the handle supporting portion 24*a*, i.e. a front portion of the attachment member 81. The engagement arm portion 81*d* can engage from above with the handle supporting portion 24*a* which protrudes inward from the outer panel 22. The engagement arm portion 81*d* is formed in a way that makes the engagement arm portion 81*d* bent like an L-shape, and extends forward from the front attachment portion 81*a*.

In the second embodiment, the attachment member 81 is formed extending between opposite end portions of the handle 23 in the longitudinal direction thereof. The temporarily-assembled state of attachment member 81 can be surely maintained by causing the engagement arm portion 81*d* to engage from above with the handle supporting portion 24*a* which protrudes inward from the outer panel 22.

Embodiments of the present invention have been described above. However, the present invention is not limited to the embodiments described above. Various design changes can be made without departing from the gist of the present invention.

For example, although the above embodiments are described by giving the ingress/egress door 21 as an example of the open/close door, the present invention can be applied to the case where a rear tailgate or a glove box is used as the open/close door.

The invention claimed is:

1. An opening/closing operation device for a vehicle open/close door, comprising:

a handle having a first end attached to the open/close door and a second end having a guide arm portion extending into the open/close door, the handle configured to swing about the first end when an opening operation force is exerted on the handle such that the second end of the handle including the guide arm portion is displaced from a first position to a second position in the direction of the opening operation force;

a latch mechanism configured to maintain a closed state of the open/close door; and a lever pivotally supported by the open/close door, the lever including a first arm portion received within an opening provided in the guide arm portion and a second arm portion configured to transmit the opening operation force to the latch mechanism, wherein a contacting tip of the first arm portion is in contact with a contact surface formed on an inside surface of the opening provided in the guide arm portion and is configured to slide along the contact surface from an initial-stage contact portion to a latter stage contact portion as the handle is displaced from the first position to the second position thereby causing the lever to pivot, wherein the initial-stage contact portion is disposed closer to an exterior of the open/close door than the latter stage contact portion, and wherein the latter-stage contact portion is formed continuously with the initial-stage contact portion along the contact surface and in a plane orthogonal to the movement direction of the guide arm portion such that the latter-stage contact portion comes into contact with the contacting tip of the first arm portion of the lever at a latter stage of the manipulation of the handle.

2. The opening/closing operation device for a vehicle open/close door according to claim 1, wherein the handle integrally has a grip portion disposed on an outer side of a panel included in the open/close door, and a base end portion of the guide arm portion is provided continuously with the grip portion, the contact surface being formed on a tip end side of the guide arm portion, the contact surface facing the grip portion, a base member is attached to the panel, the base member having: an insertion hole in which the guide arm portion is moveably inserted; and a lever supporting portion which turnably supports the lever via a pivot, the lever supporting portion is formed of a pair of side walls which are disposed respectively on opposite sides of the lever and which respectively have coaxial supporting holes for inserting and supporting opposite end portions of the pivot penetrating a pivot hole provided in the lever, an assembly guide portion and a stopper are disposed between both of the side walls and are provided in the base member, the assembly guide portion guiding a manner in which the lever, to which a return spring is assembled with one end portion of the return spring engaging with the lever, is pushed into a space between both of the side walls such that another end portion of the return spring engages with one of the side walls with the first arm portion of the lever coming in contact with the contact surface, the return spring provided between the lever supporting portion and the lever such that the lever turns and biases in a direction in which the first arm portion of the lever is brought into contact with the contact surface, and the stopper restricting the lever, which is pushed into the space between both of the side walls, at a position that makes the pivot hole correspond to the supporting holes of the side walls, and a turning position of the lever, which is pushed into the space between both of the side walls until being restricted by the stopper and which is turned and biased by a spring force exerted by the return spring, is restricted by the contact of the lever with the contact surface and the base member.

3. The opening/closing operation device for a vehicle open/close door according to claim 2, wherein a protrusion and a spring supporting portion are provided in a side wall of the pair of side walls with which the other end portion of the return spring engages, the protrusion hooking the other end portion of the return spring when the lever, to which the return spring is assembled, is pushed into the space between both of the side walls while being guided by the assembly guide portion, the spring supporting portion causing the other end portion of the return spring to be unhooked from the protrusion and to slide while maintaining an engaged state as the lever is pushed into the space between both of the side walls while being guided by the assembly guide portion.

4. The opening/closing operation device for a vehicle open/close door according to claim 2, wherein the assembly guide portion is provided in the base member such that the assembly guide portion covers, from above, at least a portion of the spring on the panel side, with the base member attached to the open/close door.

5. The opening/closing operation device for a vehicle open/close door according to claim 1, wherein the first end of the handle is swingingly supported by a panel, the handle having grip portion disposed on an outer side of the panel forming at least part of the open/close door, a fitting groove, to which an edge portion of a through-hole is fitted, is provided in one of an upper portion and a lower portion of a base member being attached to the panel and integrally having: a base member main portion having an insertion hole in which the guide arm portion is inserted; and a guide portion provided continuously with the base member main portion so as to guide the guide arm portion inserted in the insertion hole, the through-hole provided in the panel with at least the guide portion inserted therein, and the contact surface formed in a tip end side of the guide arm portion, an engagement groove opened in a direction opposite to an opening direction of the fitting groove is provided in the other one of the upper portion and the lower portion of the base member, and an attachment member able to be fastened to the base member with at least the panel interposed between the attachment member and the base member main portion is engaged with the engagement groove with the position thereof relative to the base member in an up-down direction being restricted by the slide of the attachment member on a back surface of the panel while in slide contact with the back surface of the panel.

6. The open operation device for a vehicle open/close door according to claim 5, wherein a position restriction recess portion opened in one horizontal direction is provided in one of the base member and the attachment member, and a position restriction protruding portion is provided in the other one of the base member and the attachment member, the position restriction protruding portion engaging with the position restriction recess portion when the attachment member engages with the engagement groove and thereby restricting the position of the attachment member relative to the base member in the up-down direction.

7. The open operation device for a vehicle open/close door according to claim 5, wherein the attachment member is formed extending between opposite end portions of the handle in a longitudinal direction, and an engagement arm portion is provided in the attachment member, the engagement arm portion being engageable from above with the handle supporting portion which protrudes to an inner side of the panel such that the handle supporting portion turnably supports the one end portion of the handle.

8. The open operation device for a vehicle open/close door according to claim 5, wherein an engagement protruding portion engaging with the engagement groove is provided integrally to the attachment member, and a restriction protruding portion is projectingly provided to a back surface of a sealing member interposed between at least a peripheral edge portion of the base member main portion and an outer surface of the panel, the restriction protruding portion engaging with the attachment member so as to restrict the movement of the attachment member in a sliding direction in which the attachment member engages with engagement groove while in slide contact with the back surface of the panel.

9. The opening/closing operation device for a vehicle open/close door according to claim 5, wherein a cylinder lock attachment portion protectingly surrounding a cylinder lock is provided integrally to the attachment member with the cylinder lock attached thereto.

10. The opening/closing operation device for a vehicle open/close door according to claim 3, wherein the assembly guide portion is provided in the base member such that the assembly guide portion covers, from above, at least a portion of the spring on the panel side, with the base member attached to the open/close door.

11. The opening/closing operation device for a vehicle open/close door according to claim 1, wherein the contacting tip is in contact with the initial-stage contact portion when the handle is in the first position and is in contact with the latter-stage contact portion when the handle is in the second position.

* * * * *